US011847952B2

(12) United States Patent
Heo et al.

(10) Patent No.: US 11,847,952 B2
(45) Date of Patent: Dec. 19, 2023

(54) LUMINANCE COMPENSATOR AND DISPLAY SYSTEM INCLUDING THE SAME

(71) Applicant: SAMSUNG ELECTRONICS CO., LTD., Suwon-si (KR)

(72) Inventors: Pilseung Heo, Seoul (KR); Jinyong Park, Hwaseong-si (KR); Hyeonsu Park, Seoul (KR); Hyunwook Lim, Seoul (KR)

(73) Assignee: Samsung Electronics Co., Ltd.

( * ) Notice: Subject to any disclaimer, the term of this patent is extended or adjusted under 35 U.S.C. 154(b) by 137 days.

(21) Appl. No.: 17/367,471

(22) Filed: Jul. 5, 2021

(65) Prior Publication Data

US 2022/0208067 A1 Jun. 30, 2022

(30) Foreign Application Priority Data

Dec. 28, 2020 (KR) ..... 10-2020-0184647

(51) Int. Cl.
*G09G 3/20* (2006.01)
*G09G 5/10* (2006.01)

(52) U.S. Cl.
CPC ..... *G09G 3/2074* (2013.01); *G09G 5/10* (2013.01); *G09G 2320/0233* (2013.01);
(Continued)

(58) Field of Classification Search
CPC ..... G09G 3/2074; G09G 2320/0233; G09G 2320/0242; G09G 2320/0285; G09G 2320/0626; G09G 5/10
See application file for complete search history.

(56) References Cited

U.S. PATENT DOCUMENTS 9,262,987 B2 * 2/2016 Albrecht ..... G09G 5/006
10,636,345 B2 * 4/2020 Jia ..... G09G 3/3225
(Continued)

FOREIGN PATENT DOCUMENTS

CN 201811119430 A 1/2019
CN 201910499515 A 8/2019
(Continued)

*Primary Examiner* — Amare Mengistu
*Assistant Examiner* — Jennifer L Zubajlo
(74) *Attorney, Agent, or Firm* — Fish & Richardson P.C.

(57) ABSTRACT

A luminance compensator includes a memory device and a luminance compensation circuit. The memory device stores a plurality of luminance compensation data and provides first luminance compensation data and second luminance compensation data among the plurality of luminance compensation data in response to a frame rate dimming-on signal. The first luminance compensation data corresponds to a first frame rate. The second luminance compensation data corresponds to a second frame rate. The plurality of luminance compensation data is for compensating luminance of at least one region that operates with a plurality of frame rates. The frame rate dimming-on signal represents time intervals in which frame rates of the at least one region are gradually changed. The luminance compensation circuit generates third luminance compensation data in response to the frame rate dimming-on signal, the first luminance compensation data, and the second luminance compensation data.

13 Claims, 18 Drawing Sheets

(52) U.S. Cl.
CPC ..... *G09G 2320/0242* (2013.01); *G09G 2320/0285* (2013.01); *G09G 2320/0626* (2013.01)

(56) References Cited

U.S. PATENT DOCUMENTS

| | | | | |
|---|---|---|---|---|
| 2012/0086684 | A1* | 4/2012 | Ichioka | G09G 3/3406 345/207 |
| 2014/0267370 | A1* | 9/2014 | Albrecht | G09G 5/006 345/602 |
| 2014/0267448 | A1* | 9/2014 | Albrecht | G09G 3/3406 345/84 |
| 2015/0365621 | A1* | 12/2015 | Zhang | H04N 5/7408 348/791 |
| 2016/0026044 | A1* | 1/2016 | Nam | G02F 1/1368 438/30 |
| 2019/0206335 | A1* | 7/2019 | Wu | G09G 3/3426 |
| 2020/0027424 | A1 | 1/2020 | Yoo et al. | |
| 2020/0211442 | A1 | 7/2020 | Kim et al. | |
| 2020/0251041 | A1* | 8/2020 | Peng | H03K 19/1733 |
| 2020/0327315 | A1* | 10/2020 | Mullins | G06V 20/52 |
| 2020/0401218 | A1* | 12/2020 | Camilleri | G06F 3/013 |

FOREIGN PATENT DOCUMENTS

| | | | |
|---|---|---|---|
| CN | 202010077696 | A | 8/2020 |
| KR | 20200079921 | A | 6/2020 |
| KR | 20200082347 | A | 7/2020 |

* cited by examiner

FIG. 2

| FR | FR1 | FR2 | FR3 | FR4 | FR5 | FR6 | FR7 | FR8 | FR9 | FR10 |
|---|---|---|---|---|---|---|---|---|---|---|
| LCDAT | LC1 | LC2 | LC3 | LC4 | LC5 | LC6 | LC7 | LC8 | LC9 | LC10 |

FIG. 5

| FN | FR | EXTERNAL MEMORY DEVICE(170) | LCDAT_STR1 (LCDAT1, LCDAT2) | INTERNAL MEMORY DEVICE(150) | LCDAT_STR2 (LCDAT1, LCDAT2) |
|---|---|---|---|---|---|
| F1 | FR3 | LC1-LC10 | LC3 | LC3 | LC3 |
| F2 | FR3 | LC1-LC10 | LC3 | LC3 | LC3 |
| F3 | FR3 | LC1-LC10 | LC7 | LC3, LC7 | LC7 |
| F4 | FR4 | LC1-LC10 | - | LC3, LC7 | - |
| F5 | FR5 | LC1-LC10 | - | LC3, LC7 | - |
| F6 | FR6 | LC1-LC10 | - | LC3, LC7 | - |
| F7 | FR6 | LC1-LC10 | - | LC3, LC7 | - |
| F8 | FR6 | LC1-LC10 | - | LC3, LC7 | - |
| F9 | FR7 | LC1-LC10 | - | LC3, LC7 | - |
| F10 | FR7 | LC1-LC10 | LC7 | LC7 | LC7 |

FIG. 10

| | | | | | | | | | | |
|---|---|---|---|---|---|---|---|---|---|---|
| FR | FR11 | FR12 | FR13 | FR14 | FR15 | FR16 | FR17 | FR18 | FR19 | FR20 |
| LCDAT | LC11 | LC12 | LC13 | LC14 | LC15 | LC16 | LC17 | LC18 | LC19 | LC20 |
| FR | FR21 | FR22 | FR23 | FR24 | FR25 | FR26 | FR27 | FR28 | FR29 | FR30 |
| LCDAT | LC21 | LC22 | LC23 | LC24 | LC25 | LC26 | LC27 | LC28 | LC29 | LC30 |
| FR | FR31 | FR32 | FR33 | FR34 | FR35 | FR36 | FR37 | FR38 | FR39 | FR40 |
| LCDAT | LC31 | LC32 | LC33 | LC34 | LC35 | LC36 | LC37 | LC38 | LC39 | LC40 |

FIG. 12

| FN | FR | EXTERNAL MEMORY DEVICE | (LCDAT11, LCDAT12) | LCDAT_STR1 (LCDAT11, LCDAT12) | (LCDAT11, LCDAT12) | INTERNAL MEMORY DEVICE | (LCDAT11, LCDAT12) | LCDAT_STR2 (LCDAT11, LCDAT12) | (LCDAT11, LCDAT12) |
|---|---|---|---|---|---|---|---|---|---|
| F1 | FR13,FR21,FR34 | LC11-LC40 | LC13 | LC21 | LC34 | LC13,LC21,LC34 | LC13 | LC21 | LC34 |
| F2 | FR13,FR21,FR34 | LC11-LC40 | LC17 | LC21 | LC34 | LC13,LC17,LC21,LC34 | LC17 | LC21 | LC34 |
| F3 | FR14,FR21,FR34 | LC11-LC40 | - | LC21 | LC34 | LC13,LC17,LC21,LC34 | - | LC21 | LC34 |
| F4 | FR14,FR21,FR34 | LC11-LC40 | - | LC26 | LC34 | LC13,LC17,LC21,LC26,LC34 | - | LC26 | LC34 |
| F5 | FR15,FR22,FR34 | LC11-LC40 | - | - | LC34 | LC13,LC17,LC21,LC26,LC34 | - | - | LC34 |
| F6 | FR15,FR23,FR34 | LC11-LC40 | - | - | LC38 | LC13,LC17,LC21, LC26,LC34,LC38 | - | - | LC38 |
| F7 | FR16,FR24,FR36 | LC11-LC40 | - | - | - | LC13,LC17,LC21, LC26,LC34,LC38 | - | - | - |
| F8 | FR16,FR25,FR38 | LC11-LC40 | - | - | - | LC13,LC17,LC21, LC26,LC34,LC38 | - | - | - |
| F9 | FR17,FR26,FR38 | LC11-LC40 | - | - | LC38 | LC13,LC17,LC21,LC26,LC38 | - | - | LC38 |
| F10 | FR17,FR26,FR38 | LC11-LC40 | LC17 | - | LC38 | LC17,LC21,LC26,LC38 | LC17 | - | LC38 |

LUMINANCE COMPENSATOR AND DISPLAY SYSTEM INCLUDING THE SAME

CROSS-REFERENCE TO RELATED APPLICATION

This U.S. non-provisional application claims priority under 35 USC § 119 to Korean Patent Application No. 10-2020-0184647, filed on Dec. 28, 2020, in the Korean Intellectual Property Office (KIPO), the disclosure of which is incorporated by reference herein in its entirety.

BACKGROUND

1. Technical Field

Example embodiments relate generally to semiconductor integrated circuits, and more particularly to a luminance compensator, and a display system including the luminance compensator.

2. Discussion of the Related Art

A display system capable of operating with a plurality of frame rates is being developed. The display system may include display panels such as a liquid crystal display (LCD), a plasma display panel (PD) and an organic light emitting display (OLED), and each of the display panels may include a plurality of pixels. The plurality of pixels may be manufactured to display the same luminance for input data of the same gray scale, and luminance compensation may be performed to compensate for luminance deviation caused by defects in process and design. However, when the frame rate changes as the display system operates with a plurality of frame rates, or when a plurality of regions are included in a display panel and each of the plurality of regions is independently driven with different frame rates, the luminance deviation may be recognized.

SUMMARY

Some example embodiments may provide a luminance compensator and a display system capable of generating efficiently luminance compensation data, reducing consumption of memory resources, and performing optimized luminance compensation.

According to example embodiments, a luminance compensator includes a memory device and a luminance compensation circuit. The memory device stores a plurality of luminance compensation data and provides first luminance compensation data and second luminance compensation data among the plurality of luminance compensation data in response to a frame rate dimming-on signal. The first luminance compensation data corresponds to a first frame rate. The second luminance compensation data corresponds to a second frame rate. The plurality of luminance compensation data is for compensating luminance of at least one region. The at least one region is included in a display panel and operates with a plurality of frame rates. The frame rate dimming-on signal represents time intervals in which frame rates of the at least one region are gradually changed. The luminance compensation circuit generates third luminance compensation data in response to the frame rate dimming-on signal, the first luminance compensation data, and the second luminance compensation data. The third luminance compensation data corresponds to a third frame rate.

According to example embodiments, a display system includes a display panel, an external memory device, a timing controller, and a luminance compensator. The display panel includes at least one region. The at least one region operates with a plurality of frame rates and includes a plurality of pixels. The external memory device stores a plurality of luminance compensation data for compensating luminance of the at least one region. The timing controller provides a frame rate dimming-on signal and frame rate information. The frame rate dimming-on signal represents time intervals in which frame rates of the at least on region are gradually changed. The frame rate information represents the frame rates of the at least one region. The luminance compensator stores the plurality of luminance compensation data and generates third luminance compensation data in response to the frame rate dimming-on signal, the frame rate information, first luminance compensation data, and second luminance compensation data among the plurality of luminance compensation data. The first luminance compensation data corresponds to a first frame rate, the second luminance compensation data corresponds to a second frame rate, and the third luminance compensation data corresponds to a third frame rate.

According to example embodiments, a luminance compensator includes a memory device and a luminance compensation circuit. The memory device stores a plurality of luminance compensation data and provides first luminance compensation data and second luminance compensation data among the plurality of luminance compensation data in response to a frame rate dimming-on signal. The first luminance compensation data corresponds to a first frame rate. The second luminance compensation data corresponds to a second frame rate. The plurality of luminance compensation data is for compensating luminance of at least one region. The at least one region is included in a display panel and operates with a plurality of frame rates. The frame rate dimming-on signal represents time intervals in which frame rates of the at least one region are gradually changed. The luminance compensation circuit generates third luminance compensation data in response to the frame rate dimming-on signal, the first luminance compensation data, and the second luminance compensation data. The third luminance compensation data corresponds to a third frame rate. The memory device includes a first memory and a second memory. The first memory stores the plurality of luminance compensation data. The second memory receives the first luminance compensation data and the second luminance compensation data among the plurality of luminance compensation data in response to the frame rate dimming-on signal. The second memory provides the first luminance compensation data and the second luminance compensation data to the luminance compensation circuit. The luminance compensation circuit includes a luminance compensation data provider and an image data compensator. The luminance compensation data provider receives the frame rate dimming-on signal, frame rate information, the first luminance compensation data, and the second luminance compensation data. The luminance compensation data provider generates the third luminance compensation data in response to the frame rate information, the first luminance compensation data, the second luminance compensation data, and the frame rate dimming-on signal. The image data compensator receives a plurality of input image data and the third luminance compensation data. The image data compensator compensates the plurality of input image data in response to the third luminance compensation data to generate a plurality of output image data for displaying an image.

The luminance compensator according to example embodiments may be used to compensate for luminance of a display panel operating with at least one region. The external memory device may store the plurality of luminance compensation data, and the internal memory device may store a portion of the plurality of luminance compensation data. The luminance compensator may generate luminance compensation data for compensating the luminance of the display panel using the portion of the plurality of luminance compensation data stored in the internal memory device. Accordingly, even when at least one region included in the display panel operates with a plurality of frame rates, luminance compensation data may be efficiently generated and it is possible to reduce consumption of memory resources and perform luminance compensation optimized for each region.

BRIEF DESCRIPTION OF THE DRAWINGS

Example embodiments of the present disclosure will be more clearly understood from the following detailed description taken in conjunction with the accompanying drawings.

FIG. 2 is a diagram for describing an example of luminance compensation data stored in the external memory device in FIG. 1.

FIGS. 5 and 6 are diagrams for describing an example embodiment of providing luminance compensation data in the example in FIG. 4.

FIG. 10 is a diagram illustrating an example of luminance compensation data stored in the external memory in FIG. 1.

FIGS. 12 and 13 are diagrams for describing an example embodiment of providing luminance compensation data in the example in FIG. 6.

DETAILED DESCRIPTION OF THE EMBODIMENTS

Figure 1:
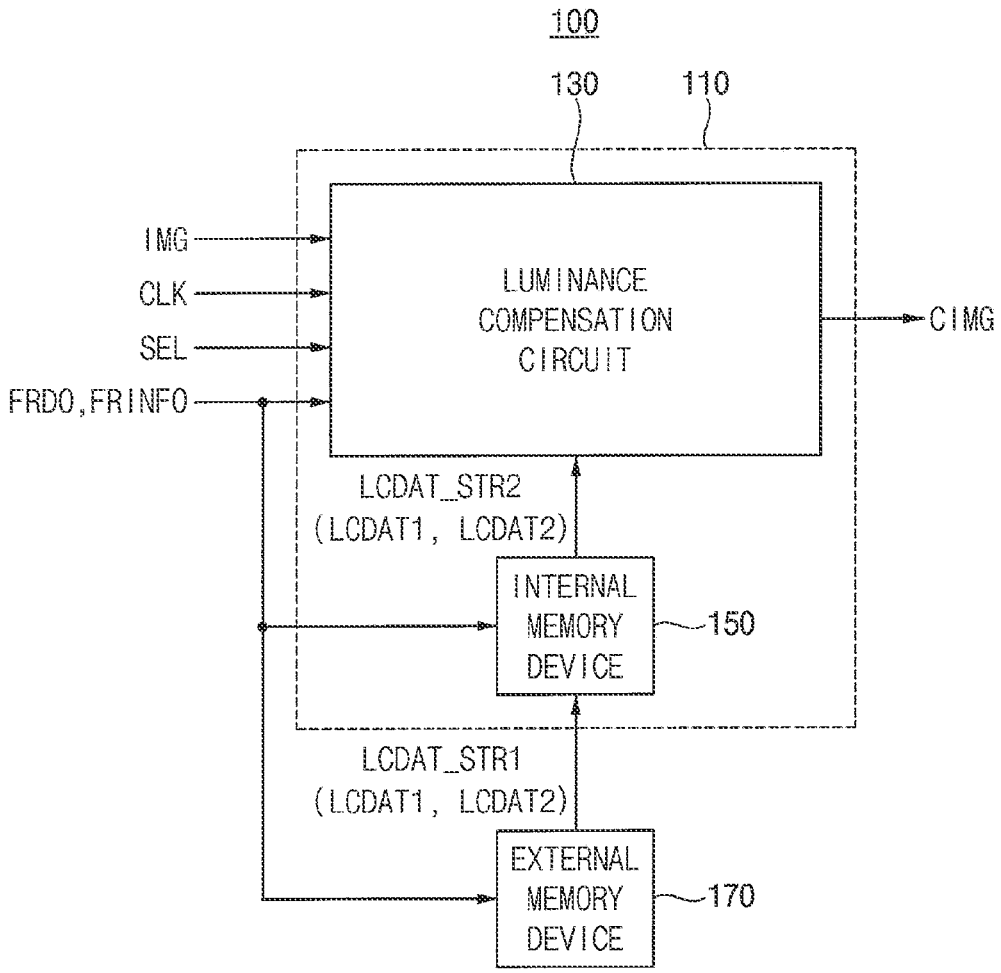
FIG. 1 is a block diagram illustrating a luminance compensation device including a luminance compensator according to example embodiments.

Various example embodiments will be described more fully hereinafter with reference to the accompanying drawings, in which some example embodiments are shown. In the drawings, like numerals refer to like elements throughout. Repeated descriptions may be omitted.

FIG. 1 is a block diagram illustrating a luminance compensation device including a luminance compensator according to example embodiments.

Referring to FIG. 1, a luminance compensation device 100 may include a luminance compensator 110 and an external memory device 170. The luminance compensator 110 may include a luminance compensation circuit 130 and an internal memory device 150.

The luminance compensator 110 may receive a plurality of input image data IMG from outside (e.g., from a host processor located outside the luminance compensation device 100) and a plurality of luminance compensation data LCDAT1 and LCDAT2 from the external memory device 170.

The luminance compensator 110 may compensate the plurality of input image data IMG in response to the plurality of luminance compensation data LCDAT1 and LCDAT2 to generate a plurality of output image data CIMG, and provide the plurality of output image data CIMG to a data driver (not shown) that drives a display panel.

In some embodiments, the display panel may operate with a plurality of frame rates. The display panel may include at least one region. For example, the display panel may include K regions operating with the plurality of frame rates, where K is an integer greater than or equal to one. In this case, the K regions may operate with different frame rates with respect to each other and the luminance compensator 110 may generate the plurality of output image data CIMG for the K regions included in the display panel.

In some embodiments, the luminance compensator 110 may further receive a frame rate dimming-on signal FRDO, frame rate information FRINFO and a selection signal SEL from outside. The frame rate dimming-on signal FRDO may represent time intervals in which frame rates of the at least one region are gradually changed to mitigate a luminance deviation when the frame rates of the at least one region are rapidly changed. The frame rate information FRINFO may represent the frame rates of the at least one region. The selection signal SEL may be a signal for selecting one of the at least one region.

The external memory device 170 may receive the frame rate dimming-on signal FRDO and the frame rate information FRINFO from outside and may provide a portion of the plurality of luminance compensation data LCDAT1 and LCDAT2 to the internal memory device 150 in response to the frame rate dimming-on signal FRDO and the frame rate information FRINFO.

In some embodiments, the luminance compensation data LCDAT1 and LCDAT2 may be luminance compensation data corresponding to a frame rate dimming start frame and a frame rate dimming end frame, which will be described later with reference to FIG. 4.

In some embodiments, the external memory device 170 may provide the plurality of luminance compensation data LCDAT1 and LCDAT2 to the internal memory device 150 in response to the frame rate dimming-on signal FRDO and may select a type of luminance compensation data LCDAT1 and LCDAT2 provided to the internal memory device 150 in response to the frame rate information FRINFO. However, example embodiments are not limited thereto. In some embodiments, the external memory device 170 may provide the plurality of luminance compensation data LCDAT1 and LCDAT2 to the internal memory device 150 in response to only the frame rate information FRINFO irrespective of the frame rate dimming-on signal FRDO. In this case, when the display system including the luminance compensator 110 is booted, the external memory device 170 may provide the plurality of luminance compensation data LCDAT1 and LCDATA2 to the internal memory device 150 in advance in response to an external signal indicating the booting.

The internal memory device 150 may store only a portion of the plurality of luminance compensation data. The internal memory device 150 may receive the frame rate dimming-on signal FRDO and the frame rate information FRINFO from outside and may provide only the portion of the plurality of luminance compensation data LCDAT1 and LCDAT2 to the luminance compensation circuit 130 in response to the frame rate dimming-on signal FRDO and the frame rate information FRINFO. In this case, the internal memory device 150 may provide the portion of the plurality of luminance compensation data LCDAT1 and LCDAT2 to the luminance compensation circuit 130 in response to the frame rate dimming-on signal FRDO, and when the display panel includes a plurality of regions, the internal memory device 150 may provide the portion of the luminance compensation data LCDAT1 and LCDAT2 to the luminance compensation circuit 130 in response to the frame rate information FRINFO to compensate for luminance of the plurality of regions included in the display panel.

In some embodiments, the external memory device 170 may be a nonvolatile memory device capable of stably storing a large amount of the plurality of luminance compensation data even when power is off and the internal memory device 150 may be a volatile memory device having a fast access speed although stored data disappears when the power is off.

In some embodiments, the external memory device 170 may include a NAND flash memory. In some embodiments, the external memory device 170 may include an electrically erasable programmable read-only memory (EEPROM), a phase change random access memory (PRAM), a resistance random access memory (RRAM), a nano floating gate memory (NFGM), a polymer random access memory (PoRAM), a magnetic random access memory (MRAM), a ferroelectric random access memory (FRAM), or the like.

In some embodiments, the internal memory device 170 may include a static random access memory (SRAM) and in some embodiments the internal memory device 170 may include a dynamic random access memory (DRAM) or a synchronous dynamic random access memory (SDRAM).

The luminance compensation circuit 130 may receive the plurality of input image data IMG, the frame rate dimming-on signal FRDO and the frame rate information FRINFO from outside and may receive the plurality of luminance compensation data LCDAT1 and LCDAT2 from the internal memory device 150.

In some embodiments, the luminance compensation circuit 130 may compensate the plurality of input image data IMG in response to a control of an external timing controller to generate a plurality of output image data CIMG. In this case, the luminance compensation circuit 130 may generate third luminance compensation data in response to the frame rate dimming-on signal FRDO, first luminance compensation data LCDAT1 and second luminance compensation data LCDAT2. The first luminance compensation data LCDAT1 and the second luminance compensation data LCDAT2 may be included in at least one of the plurality of luminance compensation data. The first luminance compensation data LCDAT1 may correspond to a first frame rate, the second luminance compensation data LCDAT2 may correspond to a second frame rate, and the third luminance compensation data LCDAT3 may correspond to a third frame rate.

The third frame rate may have a value between the first frame rate and the second frame rate. That is, when the first frame rate is higher than the second frame rate, the third frame rate may be lower than the first frame rate and higher than the second frame rate. When the first frame rate is lower than the second frame rate, the third frame rate may be higher than the first frame rate and lower than the second frame rate.

In some embodiments, the first luminance compensation data LCDAT1 and the second luminance compensation data LCDAT2 may be provided from the external memory device 170 to the internal memory device 150 and from the internal memory device 150 to the luminance compensation circuit 130 in a form of a data stream. In this case, a data stream for providing the first luminance compensation data LCDAT1 and the second luminance compensation data LCDAT2 from the external memory device 170 to the internal memory device 150 may be referred to as first luminance compensation data stream LCDAT_STR1. A data stream for providing the first luminance compensation data LCDAT1 and the second luminance compensation data LCDAT2 from the internal memory device 150 to the luminance compensation circuit 130 may be referred to as second luminance compensation data stream LCDAT_STR2.

The luminance compensator 110 according to example embodiments may be used to compensate for luminance of a display panel operating with a plurality of regions. The external memory device 170 may store the plurality of luminance compensation data, and the internal memory device 150 may store only a portion of the plurality of luminance compensation data. The luminance compensator 110 may generate luminance compensation data for compensating the luminance of the display panel using only the portion of the plurality of luminance compensation data stored in the internal memory device 150. Accordingly, even when at least one region included in the display panel operates with a plurality of frame rates, luminance compensation data may be efficiently generated and it is possible to reduce consumption of memory resources and perform luminance compensation optimized for each region.

FIG. 2 is a diagram for describing an example of luminance compensation data stored in the external memory device in FIG. 1.

Referring to FIGS. 1 and 2, a display panel may include at least one region and may operate with a plurality of frame rates FR. In FIG. 2, an example is illustrated of luminance compensation data LCDAT for compensating luminance of the display panel when the display panel includes one region.

In some embodiments, a region of the display panel (e.g., the entire region) may operate with first to tenth frame rates FR1, FR2, FR3, FR4, FR5, FR6, FR7, FR8, FR9 and FR10. In this case, a plurality of luminance compensation data LC1, LC2, LC3, LC4, LC5, LC6, LC7, LC8, LC9 and LC10 for compensating the region of the display panel may be generated.

As described above with reference to FIG. 1, the plurality of luminance compensation data LC1 to LC10 may be stored in the external memory device 170 and only a portion of the plurality of luminance compensation data LC1 to LC10 may be provided to the internal memory device 150.

In some embodiments, the luminance compensation data LC1 may be data LCDAT for compensating the luminance of the region when the region operates with a first frame rate FR1, the luminance compensation data LC2 may be data LCDAT for compensating the luminance of the region when the region operates with a second frame rate FR2, and the luminance compensation data LC3 may be data LCDAT for compensating the luminance of the region when the region operates with a third frame rate FR3. The luminance compensation data LC4 to LC10 may be data LCDAT for compensating the luminance of the region when the region operates with a fourth to tenth frame rate FR4 to FR10 similarly to the luminance compensation data LC1 to LC3.

In FIG. 2, the luminance compensation data LC1 to LC10 corresponding to the first to tenth frame rates FR1 to FR10 are illustrated, but the number of frame rates and the number of luminance compensation data are not limited thereto.

Figure 3:
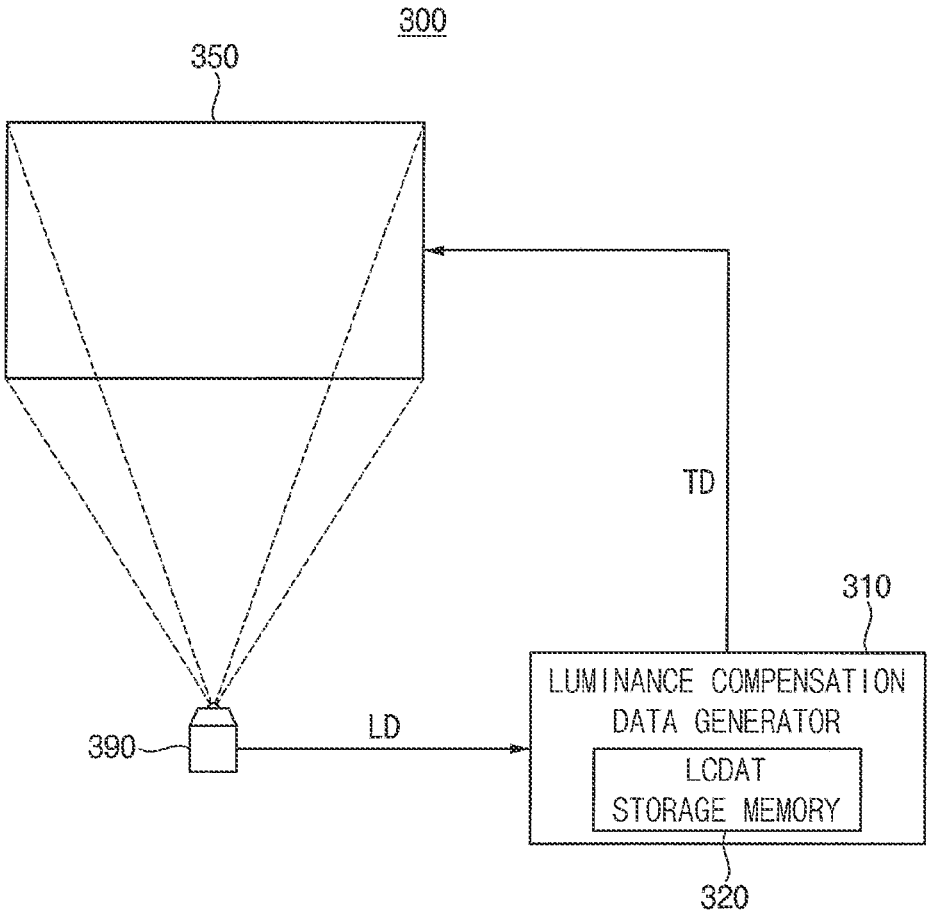
FIG. 3 is a block diagram illustrating an example embodiment of a luminance compensation data generation system that generates the luminance compensation data in FIG. 2.

FIG. 3 is a block diagram illustrating an example embodiment of a luminance compensation data generation system that generates the luminance compensation data in FIG. 2.

Referring to FIG. 3, a luminance compensation data generation system 300 may generate a plurality of luminance compensation data for compensating luminance of the display panel. As described above with reference to FIGS. 1 and 2, the display panel may operate with a plurality of frame rates. The display panel may include at least one region, and when the display panel includes two or more regions, the two or more regions may operate with different frame rates with respect to each other.

In some embodiments, the luminance compensation data generation system 300 may generate a plurality of luminance compensation data corresponding to a plurality of frame rates with which the display panel operates. The plurality of luminance compensation data may be generated to compensate for defects in process and design of the display panel before the display panel is implemented as a display system.

In some embodiments, when a manufacturer of the display panel and a manufacturer of the display system are different from each other, the plurality of luminance compensation data are generated by the luminance compensation data generation system 300, which is distinguished from the display system. The plurality of luminance compensation data may be stored in a memory device and then implemented in the display system as the external memory device 170 in FIG. 1.

The luminance compensation data generation system 300 may include a luminance compensation data generator 310, a display panel 350 and a photographing device 390.

The luminance compensation data generator 310 may provide a plurality of test image data TD to the display panel 350. In some embodiments, each of the plurality of test image data TD may correspond to a frame rate. For example, the plurality of test image data TD may correspond to 'L' frame rates, respectively. In some embodiments, when the plurality of test image data TD corresponding to a first to tenth frame rates, respectively, are provided to the display panel 350, the first to tenth frame rates may be 1 Hz, 10 Hz, 20 Hz, 30 Hz, 40 Hz, 50 Hz, 60 Hz, 70 Hz, 80 Hz, 90 Hz and 100 Hz, respectively. However, example embodiments are not limited thereto.

The display panel 350 may display a panel image in response to the plurality of test image data TD. The photographing device 390 may photograph the panel image and generate a plurality of luminance data LD. The luminance compensation data generator 310 may generate a plurality of luminance compensation data in response to the plurality of luminance data LD. The luminance compensation data generator 310 may store a plurality of luminance compensation data in the luminance compensation data storage memory 320.

Figure 4:
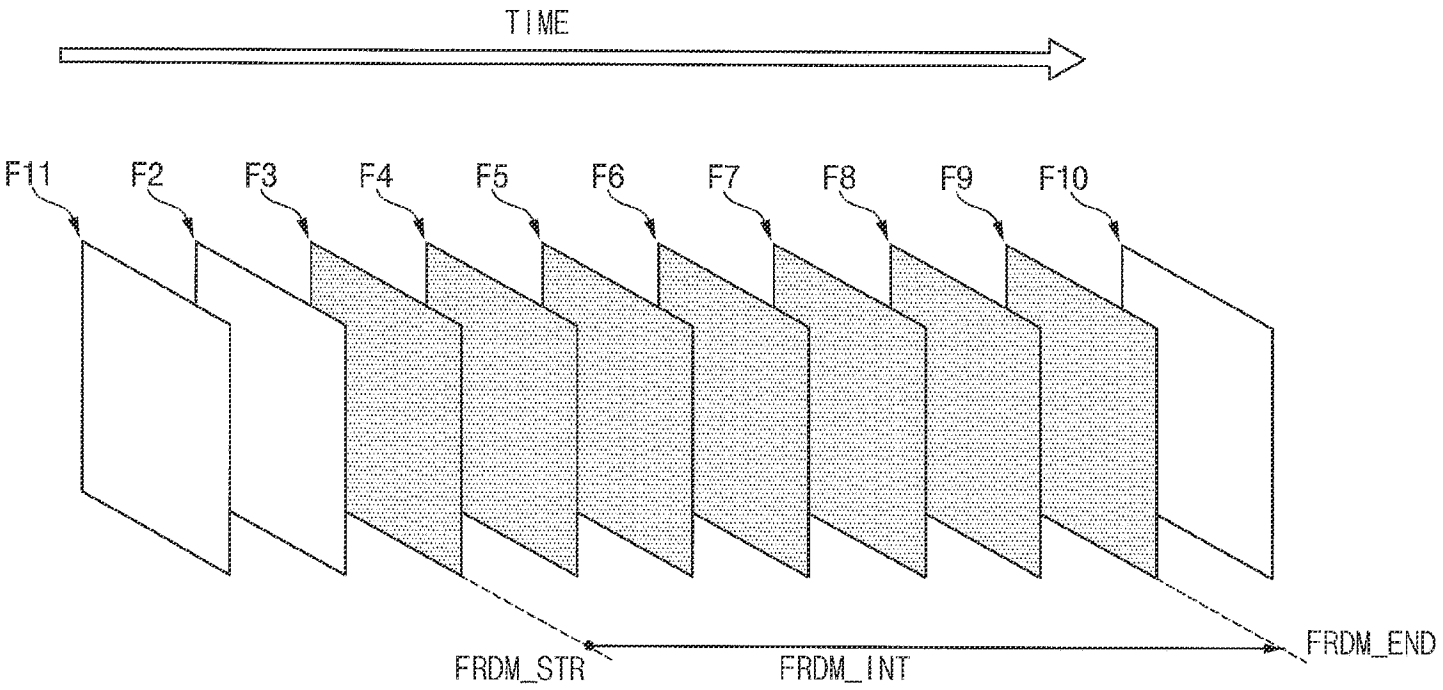
FIG. 4 is a diagram for describing an example of a display panel operating with a plurality of frame rates.

FIG. 4 is a diagram for describing an example of a display panel operating with a plurality of frame rates.

FIG. 4 illustrates an example where the display panel described above with reference to FIGS. 1 to 3 includes a region operating with a plurality of frame rates as time elapses.

Referring to FIG. 4, the display panel may display a plurality of images from a first frame F1 to a tenth frame F10 as time elapses. For example, although not illustrated in detail, the frame rate of the display panel may be gradually changed from the second frame F2 to the ninth frame F9. The frame rate may be changed for mitigating luminance deviation when the frame rate of the region included in the display panel changes rapidly as described above with reference to FIG. 1.

A frame rate dimming start frame FRDM_STR and a frame rate dimming end frame FRDM_END may be defined. The frame rate dimming start frame FRDM_STR may represent a frame at which the change of the frame rate starts, and the frame rate dimming end frame FRDM_END may represent a frame at which the change of the frame rate ends. A time interval between the frame rate dimming start frame FRDM_STR and the frame rate dimming end frame FRDM_END may be defined as a frame rate dimming interval FRDM_INT.

In some embodiments, the frame rate dimming-on signal FRDO described above with reference to FIG. 1 may represent a frame rate dimming start frame FRDM_STR and a frame rate dimming end frame FRDM_END. In some embodiments, the frame rate dimming-on signal FRDO may also represent the frame rate dimming interval FRDM_INT.

Figure 6:
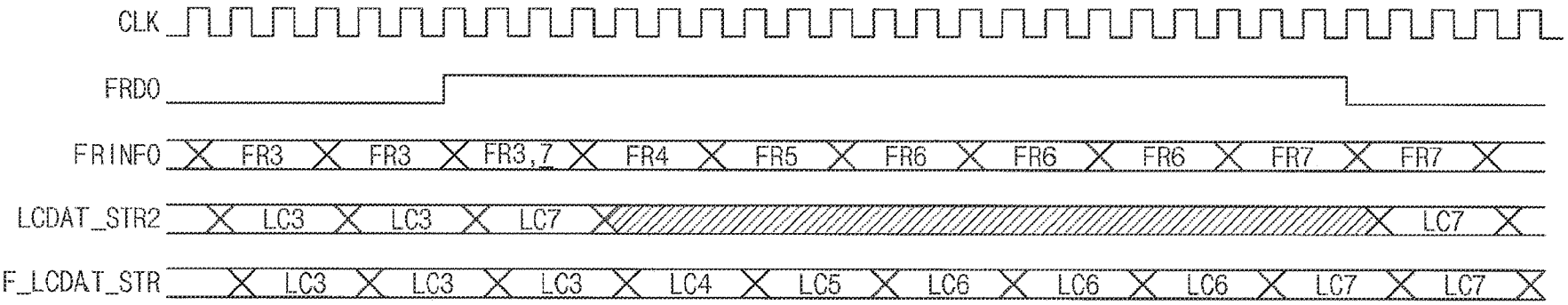

FIGS. 5 and 6 are diagrams for describing an example embodiment of providing luminance compensation data in the example in FIG. 4.

In FIG. 5, a frame number FN of a display panel and a frame rate FR corresponding to the frame number FN are illustrated. The frame number FN corresponds to one of the plurality of frames F1 to F10 described above with reference to FIG. 4. The frame rate FR corresponds to one of the first to tenth frame rates FR1 to FR10 described above with reference to FIG. 2.

Hereinafter, for convenience of description, it is assumed that the first frame rate FR1 represents the least frame rate, and the tenth frame rate FR10 represents the greatest frame rate, among the first to tenth frame rates FR1 to FR10. That is, the first to tenth frame rates FR1 to FR10 are considered to represent frame rates that increase from the first frame rate FR1 to the tenth frame rate FR10. However, example embodiments are not limited thereto. In some embodiments, the first frame rate FR1 may represent the greatest frame rate and the tenth frame rate FR10 may represent the least frame rate.

In FIG. 6, a clock signal CLK, a frame rate dimming-on signal FRDO, a frame rate information FRINFO, a second luminance compensation data stream LCDAT_STR2 and a final luminance compensation data stream F_LCDAT_STR are illustrated. The final luminance compensation data stream F_LCDAT_STR will be described later with reference to FIGS. 7 and 8.

Referring to FIGS. 1 to 6, in the first frame F1, a display panel operates with the third frame rate FR3, and the frame rate of the display panel is maintained up to the third frame F3. In the fourth frame F4, the frame rate increases to the fourth frame rate FR4, and in the fifth frame rate F5, the frame rate increases to the fifth frame rate FR5. In the sixth frame F6, the frame rate increases to the sixth frame rate FR6, and the frame rate is maintained up to the eight frame F8. In the ninth frame F9, the frame rate increases to the seventh frame rate FR7, and the frame rate is maintained up to the tenth frame F10.

In some embodiments, the frame rate dimming-on signal FRDO described above with reference to FIGS. 1 to 4 may correspond to a first level (e.g., a low level in FIG. 6) in the first frame F1, the second frame F2 and the tenth frame F10, and correspond to a second level (e.g., a high level in FIG. 6) different from the first level from the third frame F3 to the ninth frame F9.

When the frame rate dimming-on signal FRDO transitions from the first level to the second level, it may represent an interval in which the frame rate changes rapidly (i.e., an increase or a decrease interval), and when the frame rate dimming-on signal FRDO transitions from the second level to the first level, it may represent an interval in which the frame rate does not change (i.e., an interval in which the frame rate does not increase or decrease). In this case, the frame rate information FRINFO may represent the frame rate in which a region of the display panel operates, in particular, when the frame rate dimming-on signal FRDO transitions from the first level to the second level, the frame rate information FRINFO may represent frame rates (e.g., FR3 and FR7 in FIG. 6) corresponding to the frame rate dimming start frame and the frame rate dimming end frame, respectively. In this case, the external memory device 170 may store a plurality of luminance compensation data LC1 to LC10 respectively corresponding to the first to tenth frame F1 to F10 or the first to tenth frame rates FR1 to FR10.

In the first and second frames F1 and F2, the external memory device 170 may provide the luminance compensation data LC3 corresponding to the third frame rate FR3 as the first luminance compensation data LCDAT1 to the internal memory device 150 based on the frame rate information FRINFO. The internal memory device 150 may temporarily store the luminance compensation data LC3 and provide the luminance compensation data LC3 to the luminance compensation circuit 130. In the third frame F3, the external memory device 170 may provide the luminance compensation data LC7 corresponding to the seventh frame rate FR7 as the second luminance compensation data LCDAT2 to the internal memory device 150 based on the frame rate information FRINFO.

In some embodiments, the luminance compensation data LC3 may correspond to the frame rate dimming start frame FRDM_STR described above with reference to FIG. 4 and the luminance compensation data LC7 may correspond to the frame rate dimming end frame FRDM_END described above with reference to FIG. 4.

The internal memory device 150 may temporarily store the luminance compensation data LC3 and LC7 and provide the luminance compensation data LC3 and LC7 to the luminance compensation circuit 130.

In the fourth to ninth frames F4 to F9, the external memory device 170 and the internal memory device 150 do not provide the luminance compensation data to the internal memory device 150 and the luminance compensation circuit 130, respectively and may have a rest interval (e.g., a hatched portion of the second luminance compensation data stream LCDAT_STR2 in FIG. 6). The luminance compensation data (e.g., LC4, LC5, LC6 and LC7) corresponding to the fourth to ninth frames F4 to F9 may be generated by the luminance compensation circuit 130 (more specifically, the interpolation circuit 147 in FIG. 8 included in the luminance compensation data provider 133 in FIG. 7) based on the luminance compensation data (e.g., LC3 and LC7) provided in previous frames (e.g., F2 and F3).

In the tenth frame F10, the external memory device 170 may provide the luminance compensation data LC7 corresponding to the seventh frame rate FR7 as the second luminance compensation data LCDAT2 to the internal memory device 150. The internal memory device 150 may temporarily store the luminance compensation data LC7 and provide the luminance compensation data LC7 to the luminance compensation circuit 130.

That is, when the frame rate dimming-on signal FRDO transitions to the second level and is maintained, the external memory device 170 may provide a portion of the plurality of luminance compensation data LC1 to LC10 to the internal memory device 150 once within a predetermined time interval (e.g., in FIG. 5, the interval until at least one frame number increases). Further, when the frame rate dimming-on signal FRDO transitions to the first level and is maintained, the external memory device 170 may provide luminance compensation data corresponding to a frame rate with which the display panel operates from among the plurality of luminance compensation data LC1 to LC10 to the internal memory device 150 based on the frame rate information FRINFO whenever the frame number FN changes.

Figure 7:
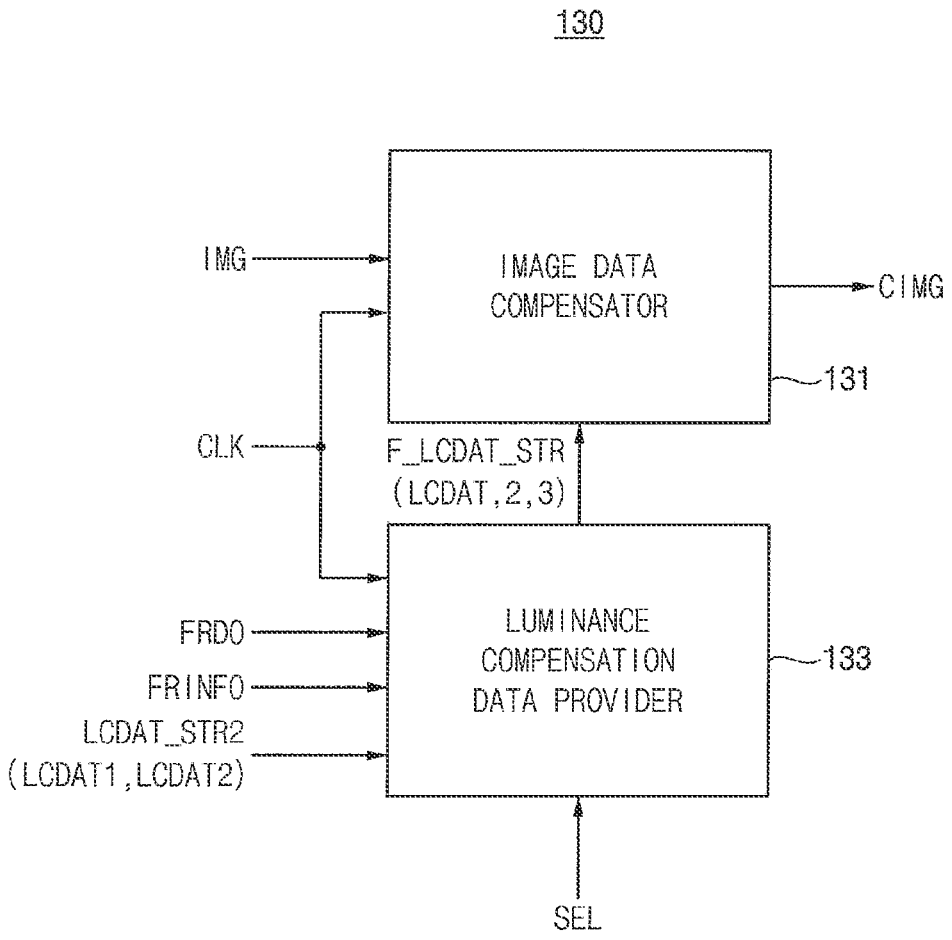
FIG. 7 is a block diagram illustrating an example embodiment of the luminance compensation circuit in FIG. 1.

FIG. 7 is a block diagram illustrating an example embodiment of the luminance compensation circuit in FIG. 1.

Referring to FIG. 7, a luminance compensation circuit 130 may include an image data compensator 131 and a luminance compensation data provider 133. The image data compensator 131 and the luminance compensation data provider 133 may operate based on a commonly input clock signal CLK.

The luminance compensation data provider 133 may receive a frame rate dimming-on signal FRDO, frame rate information FRINFO, first luminance compensation data LCDAT1, and second luminance compensation data LCDAT2.

In some embodiments, as described above with reference to FIG. 1, the first luminance compensation data LCDAT1 and the second luminance compensation data LCDAT2 may be received in a form of a second luminance compensation data stream LCDAT_STR2.

In some embodiments, as described above with reference to FIGS. 5 and 6, the luminance compensation data provider 133 may receive only the first luminance compensation data LCDAT1 before the frame rate dimming-on signal FRDO transitions to the second level, the luminance compensation data provider 133 may receive only the second luminance compensation data LCDAT2 when the frame rate dimming-on signal FRDO transitions to the second level, and the luminance compensation data provider 133 may receive only the second luminance compensation data LCDAT2 after the frame rate dimming-on signal FRDO transitions from the second level to the first level.

When the frame rate dimming-on signal FRDO corresponds to the first level, the luminance compensation data provider 133 may provide one of the first luminance compensation data LCDAT1 and the second luminance compensation data LCDAT2 to the image data compensator 131, and when the frame rate dimming-on signal FRDO corresponds to the second level, the luminance compensation data provider 133 may generate a third luminance compensation data LCDAT3 in response to the frame rate information FRINFO, the first luminance compensation data LCDAT1 and the second luminance compensation data LCDAT2 to provide the third luminance compensation data LCDAT3 to the image data compensator 131. The third luminance compensation data LCDAT3 may correspond to a frame rate with which the display panel operates. A configuration for generating the third luminance compensation data LCDAT3 will be described later with reference to FIGS. 8 and 14. For example, when the frame rate dimming-on signal FRDO corresponds to the second level, the first luminance compensation data LCDAT1 may correspond to the luminance compensation data LC3, the second luminance compensation data LCDAT2 may correspond to the luminance compensation data LC7, and the third luminance compensation data LCDAT3 may correspond to the luminance compensation data LC4, LC5 and LC6.

In some embodiments, the first to third luminance compensation data LCDAT1 to LCDAT3 may be provided from the luminance compensation data provider 133 to the image data compensator 131 in a form of a final luminance compensation data stream F_LCDAT_STR. The final luminance compensation data stream F_LCDAT_STR may be provided from the luminance compensation data provider 133 to the image data compensator 131 as in the example illustrated in FIG. 6.

The image data compensator 131 may receive a plurality of input image data IMG from outside and receive one of the first to third luminance compensation data LCDAT1, LCDAT2 and LCDAT3 from the luminance compensation data provider 133. The image data compensator 131 may compensate the plurality of input image data IMG in response to one of the first to third luminance compensation data LCDAT1, LCDAT2 and LCDAT3 to generate a plurality of output images CIMG for displaying an image.

Figure 8:
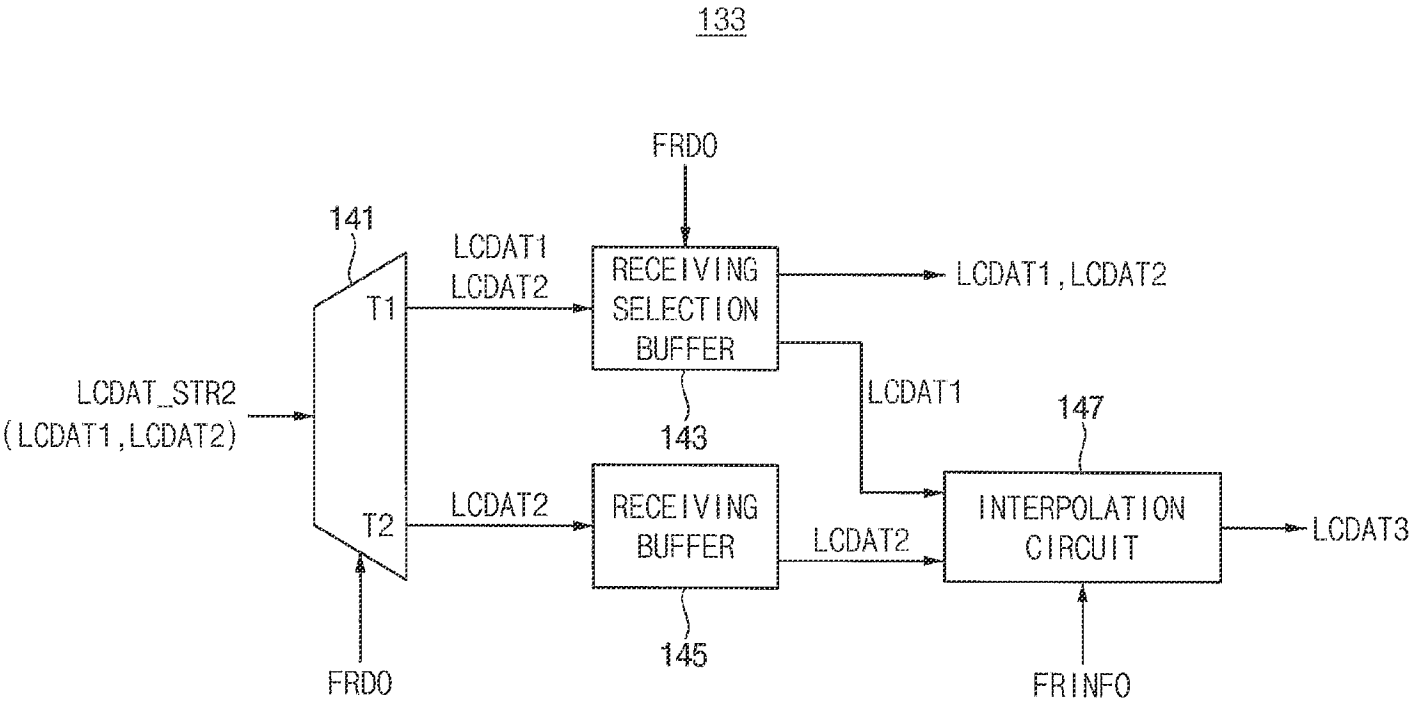
FIG. 8 is a block diagram illustrating an example embodiment of the luminance compensation data provider in FIG. 7.

FIG. 8 is a block diagram illustrating an example embodiment of the luminance compensation data provider in FIG. 7.

Referring to FIGS. 7 and 8, a luminance compensation data provider 133 may include a demultiplexer 141, a receiving selection buffer 143, a receiving buffer 145 and an interpolation circuit 147.

The demultiplexer 141 may receive first luminance compensation data LCDAT1 and second luminance compensation data LCDAT2. In some embodiments, the demultiplexer 141 may receive the first luminance compensation data LCDAT1 and the second luminance compensation data LCDAT2 from the internal memory device 150 in FIG. 1.

The demultiplexer 141 may provide one of the first luminance compensation data LCDAT1 and the second luminance compensation data LCDAT2 to a first terminal T1 or provide the second luminance compensation data LCDAT2 to a second terminal T2, in response to a frame rate dimming-on signal FRDO. In some embodiments, the demultiplexer 141 may provide one of the first luminance compensation data LCDAT1 and the second luminance compensation data LCDAT2 to the receiving selection buffer 143 when the frame rate dimming-on signal FRDO corresponds to a first level and the demultiplexer 141 may provide the second luminance compensation data LCDAT2 to the receiving buffer 145 when the frame rate dimming-on signal FRDO corresponds to a second level.

The receiving selection buffer 143 is connected to the first terminal T1 to receive and temporarily store the first luminance compensation data LCDAT1 and the second luminance compensation data LCDAT2 from the demultiplexer 141.

The receiving selection buffer 143 further receives the frame rate dimming-on signal FRDO and may output the first luminance compensation data LCDAT1 and the second luminance compensation data LCDAT2 to the image data compensator 131 or output the first luminance compensation data LCDAT1 to the interpolation circuit 147, in response to the frame rate dimming-on signal FRDO. In some embodiments, the receiving selection buffer 143 may output the first luminance compensation data LCDAT1 and the second luminance compensation data LCDAT2 to the image data compensator 131 when the frame rate dimming-on signal FRDO corresponds to the first level and the receiving selection buffer 143 may output the first luminance compensation data LCDAT1 to the interpolation circuit 147 when the frame rate dimming-on signal FRDO corresponds to the second level.

The receiving buffer 145 is connected to the second terminal T2 to receive and temporarily store the second luminance compensation data LCDAT2 from the demultiplexer 141.

The interpolation circuit 147 is connected to the receiving selection buffer 143 and the receiving buffer 145 to receive and temporarily store the first luminance compensation data LCDAT1 and the second luminance compensation data LCDAT2. The interpolation circuit 147 further receives the frame rate information FRINFO and may generate the third luminance compensation data LCDAT3 in response to the frame rate information FRINFO, the first luminance compensation data LCDAT1 and the second luminance compensation data LCDAT2 to output the third luminance compensation data LCDAT3 to the image data compensator 131. In some embodiments, the interpolation circuit 147 may generate the third luminance compensation data LCDAT3 in response to the frame rate information FRINFO, the first luminance compensation data LCDAT1 and the second luminance compensation data LCDAT2 when the frame rate dimming-on signal FRDO corresponds to the second level. In this case, the frame rate information FRINFO may include coefficients required in the process of performing the interpolation. For example, in the embodiment in FIG. 6, the interpolation circuit 147 may receive the luminance compensation data (e.g., LC3) as the first luminance compensation data LCDAT1 and the luminance compensation data (e.g., LC7) as the second luminance compensation data LCDAT2. The interpolation circuit 147 may interpolate the first luminance compensation data LCDAT1 and the second luminance compensation data LCDAT2 to generate the luminance compensation data LC4, LC5 and LC6 as the third luminance compensation data LCDAT3.

In some embodiments, the first to third luminance compensation data LCDAT1 to LCDAT3 may be provided from the luminance compensation data provider 133 to the image data compensator 131 in a form of a final luminance compensation data stream F_LCDAT_STR.

Figure 9:
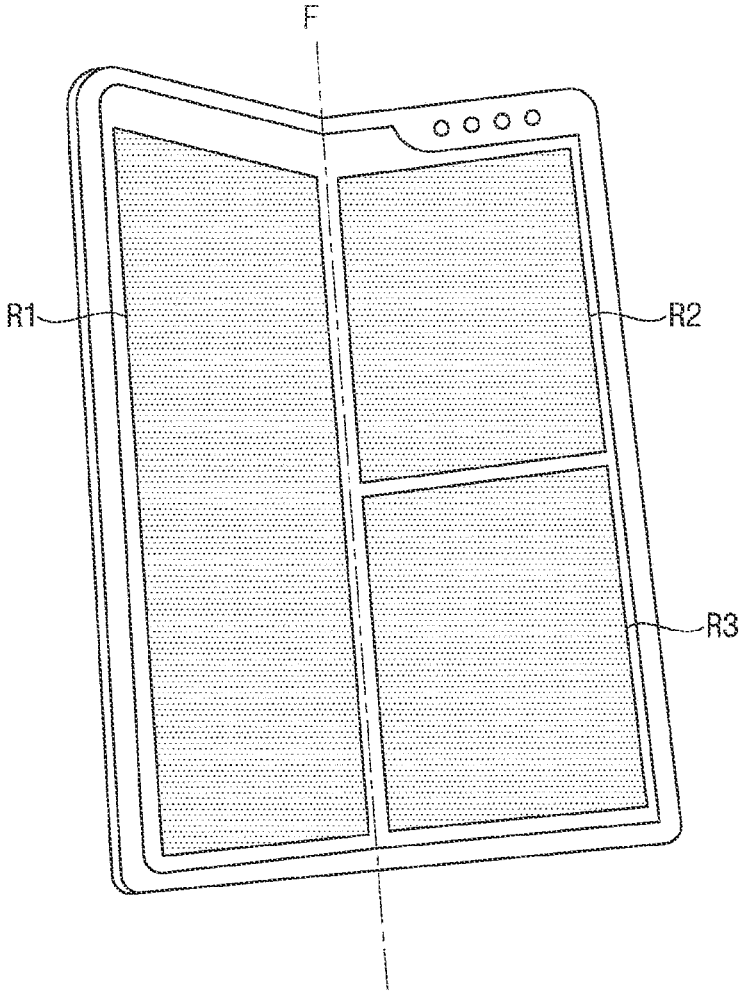
FIG. 9 is a diagram for describing an example of a plurality of regions included in a display panel and independently driven with different frame rates with respect to each other.

FIG. 9 is a diagram for describing an example of a plurality of regions included in a display panel and independently driven with different frame rates with respect to each other.

In FIG. 9, a foldable electronic device including a display panel is illustrated. As described above with reference to FIG. 1, the display panel may include at least one region.

Referring to FIG. 9, the display panel may include a first region R1 on one side and a second region R2 and a third region R3 on the other side around a folding axis F.

Each of the first region R1, the second region R2 and the third region R3 may operate with different frame rates, respectively. In this case, a frame rate dimming-on signal FRDO may be independently set for each of the first region R1, the second region R2 and the third region R3. For example, a first frame rate dimming-on signal FRDO1 may be set for the first region R1, a second frame rate dimming-on signal FRDO2 may be set for the second region R2, and a third frame rate dimming-on signal FRDO3 may be set for the third region R3.

FIG. 10 is a diagram illustrating an example of luminance compensation data stored in the external memory in FIG. 1.

In FIG. 10, an example of luminance compensation data LCDAT for compensating luminance of a display panel when the display panel includes three regions is illustrated.

In some embodiments, a first region R1 of the display panel may operate with eleventh to twentieth frame rates FR11 to FR20. A second region R2 of the display panel may operate with twenty-first to thirties frame rates FR21 to FR30. A third region R3 of the display panel may operate with thirty-first to fortieth frame rates FR31 to FR40. In this case, a plurality of luminance compensation data LC11 to LC20 for compensating the luminance of the first region R1 may be generated, a plurality of luminance compensation data LC21 to LC30 for compensating the luminance of the second region R2 may be generated, and a plurality of luminance compensation data LC31 to LC40 may be generated.

As described above with reference to FIG. 1, a plurality of luminance compensation data LC11 to LC40 may be stored in the external memory device 170 and only a portion of the plurality of luminance compensation data LC11 to LC40 may be provided to and stored in the internal memory device 150 to compensate for the plurality of input image data IMG input to the luminance compensator 110.

In some embodiments, the luminance compensation data LC11 may be luminance compensation data LCDAT for compensating the luminance of the first region R1 when the first region R1 operates with the eleventh frame rate FR11, the luminance compensation data LC12 may be luminance compensation data LCDAT for compensating the luminance of the first region R1 when the first region R1 operates with the twelfth frame rate FR12, and the luminance compensation data LC13 may be luminance compensation data LCDAT for compensating the luminance of the first region R1 when the first region R1 operates with the thirteenth frame rate FR13. The luminance compensation data LC14 to LC20 may be luminance compensation data LCDAT for compensating the luminance of the first region R1 when the first region R1 operates with the fourteenth to twentieth frame rates FR14 to FR20, in a similar manner to the luminance compensation data LC11 to LC13.

In some embodiments, the luminance compensation data LC21 may be luminance compensation data LCDAT for compensating the luminance of the second region R2 when the second region R2 operates with the twenty-first frame rate FR21, the luminance compensation data LC22 may be luminance compensation data LCDAT for compensating the luminance of the second region R2 when the second region R2 operates with the twenty-second frame rate FR22, and the luminance compensation data LC23 may be luminance compensation data LCDAT for compensating the luminance of the second region R2 when the second region R2 operates with the twenty-third frame rate FR23. The luminance compensation data LC24 to LC30 may be luminance compensation data LCDAT for compensating the luminance of the second region R2 when the second region R2 operates with the twenty-fourth to thirtieth frame rates FR24 to FR30, in a similar manner to the luminance compensation data LC21 to LC23.

In some embodiments, the luminance compensation data LC31 may be luminance compensation data LCDAT for compensating the luminance of the third region R3 when the third region R3 operates with the thirty-first frame rate FR31, the luminance compensation data LC32 may be luminance compensation data LCDAT for compensating the luminance of the third region R3 when the third region R3 operates with the thirty-second frame rate FR32, and the luminance compensation data LC33 may be luminance compensation data LCDAT for compensating the luminance of the third region R3 when the third region R3 operates with the thirty-third frame rate FR33. The luminance compensation data LC34 to LC40 may be luminance compensation data LCDAT for compensating the luminance of the third region R3 when the third region R3 operates with the thirty-fourth to fortieth frame rates FR34 to FR40, in a similar manner to the luminance compensation data LC31 to LC33.

Figure 11:
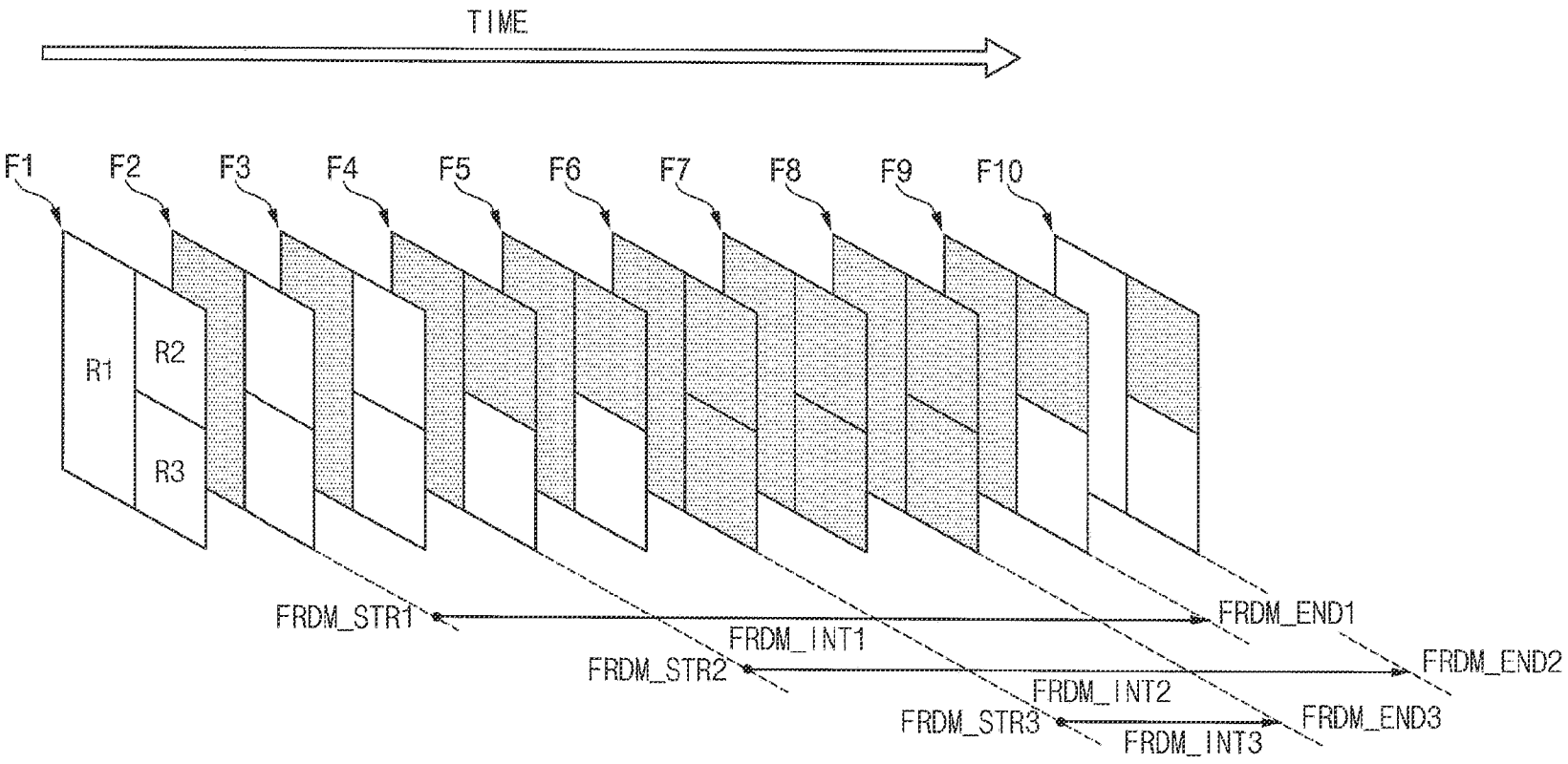
FIG. 11 is a diagram for describing an example of a display panel operating with a plurality of frame rates.

FIG. 11 is a diagram for describing an example of a display panel operating with a plurality of frame rates.

FIG. 11 illustrates an example where the display panel described above with reference to FIGS. 1, 9 and 10 includes three regions operate with a plurality of frame rates as time elapses.

Referring to FIG. 11, the display panel may display a plurality of images from a first frame F1 to a tenth frame F10 as time elapses. For example, the frame rate of the first region R1 included in the display panel may be gradually changed from the second frame F2 to the ninth frame F9. The frame rate of the second region R2 included in the display panel may be gradually changed from the fourth frame F4 to the tenth frame F10. The frame rate of the third region R3 included in the display panel may be gradually changed from the sixth frame F6 to the eighth frame F8. The frame rate may be changed for mitigating luminance deviation when the frame rate of each of the first region R1, the second region R2 and the third region R3 included in the display panel changes rapidly as described above with reference to FIG. 1.

Frame rate dimming start frames FRDM_STR1, FRDM_STR2 and FRDM_STR3 and frame rate dimming end frames FRDM_END1, FRDM_END2 and FRDM_END3 may be defined for the first region R1, the second region R2 and the third region R3, respectively. The frame rate dimming start frames FRDM_STR1, FRDM_STR2 and FRDM_STR3 may represent frames at which the change of the frame rate starts, and the frame rate dimming end frames FRDM_END1, FRDM_END2 and FRDM_END3 may represent frames at which the change of the frame rate ends. Time intervals between the frame rate dimming start frames FRDM_STR1, FRDM_STR2 and FRDM_STR3 and frame rate dimming end frames FRDM_END1, FRDM_END2 and FRDM_END3 may be defined as frame rate dimming intervals FRDM_INT1, FRDM_INT2 and FRDM_INT3.

In some embodiments, the frame rate dimming-on signal FRDO described above with reference to FIG. 1 may represent frame rate dimming start frames FRDM_STR1, FRDM_STR2 and FRDM_STR3 and frame rate dimming end frames FRDM_END1, FRDM_END2 and FRDM_END3. In some embodiments, the frame rate dimming-on signal FRDO may also represent the frame rate dimming intervals FRDM_INT1, FRDM_INT2 and FRDM_INT3.

Figure 13:
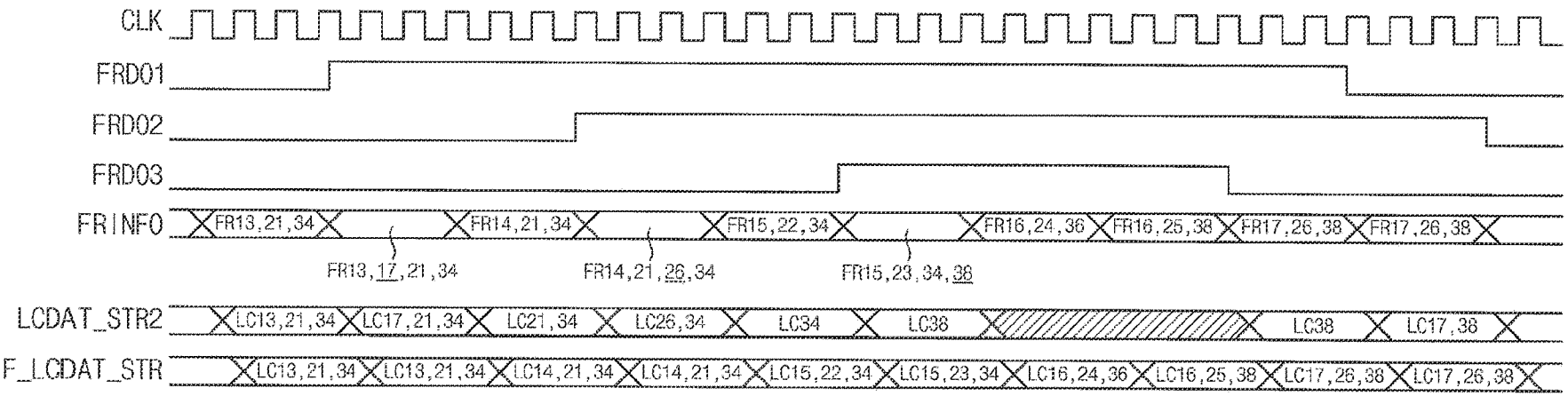

FIGS. 12 and 13 are diagrams for describing an example embodiment of providing luminance compensation data in the example in FIG. 6.

In FIG. 12, a frame number FN of a display panel and a frame rate FR corresponding to the frame number FN are illustrated. The frame number FN corresponds to one of the plurality of frames F1 to F10 described above with reference to FIG. 11. The frame rate FR corresponds to one of the eleventh to fortieth frame rates FR11 to FR40 described above with reference to FIG. 10.

Hereinafter, for convenience of description, it is assumed that the eleventh frame rate FR11 represents the least frame rate and the fortieth frame rate FR40 represents the greatest frame rate, among the eleventh frame rate to fortieth frame rate FR11 to FR40. That is, the eleventh to fortieth frame rates FR11 to FR40 are considered to represent frame rates that increase from the eleventh frame rate FR11 to the fortieth frame rate FR40. However, example embodiments are not limited thereto. In some embodiments, the eleventh frame rate FR11 may represent the greatest frame rate and the fortieth frame rate FR40 may represent the least frame rate.

In FIG. 13, a clock signal CLK, frame rate dimming-on signals FRDO1 to FRDO3, a second luminance compensation data stream LCDAT_STR2 and a final luminance compensation data stream F_LCDAT_STR are illustrated.

The first region R1 will be described first with reference to FIGS. 1 and 9 to 12. In the first frame F1, a display panel operates with the thirteenth frame rate FR13 and the frame rate of the display panel is maintained up to the second frame F2. In the third frame F3, the frame rate increases to the fourteenth frame rate FR14 and the frame rate is maintained up to the fourth frame F4. In the fifth frame F5, the frame rate increases to the fifteenth frame rate FR15 and the frame rate is maintained up to the sixth frame F6. In the seventh frame F7, the frame rate increases to the sixteenth frame rate FR16 and the frame rate is maintained up to the eighth frame F8. In the ninth frame F9, the frame rate increases to the seventeenth frame rate FR17 and the frame rate in maintained up to the tenth frame F10.

In some embodiments, the frame rate dimming-on signal FRDO1 may correspond to a first level (e.g., a low level in FIG. 13) in the first frame F1 and the tenth frame F10, and correspond to second level (e.g., a high level in FIG. 13) different from the first level from the second frame F2 to the ninth frame F9.

When the frame rate dimming-on signal FRDO1 transitions from the first level to the second level, it may represent an interval in which the frame rate changes (i.e., an increase or a decrease interval), and when the frame rate dimming-on signal FRDO1 transitions from the second level to the first level, it may represent an interval in which the frame rate does not change (i.e., an interval in which the frame rate does not increase or decrease). In this case, the frame rate information FRINFO may represent the frame rate in which a region of the display panel operates, in particular, when the frame rate dimming-on signal FRDO transitions from the first level to the second level, the frame rate information FRINFO may represent frame rates (e.g., FR13 and FR17 in FIG. 13) corresponding to the frame rate dimming start frame and the frame rate dimming end frame, respectively. In this case, the external memory device 170 may store a plurality of luminance compensation data LC11 to LC20 respectively corresponding to the first to tenth frame F1 to F10 or the eleventh to twentieth frame rates FR11 to FR20.

In the first and second frame F1 and F2, the external memory device 170 may provide the luminance compensation data LC13 corresponding to the thirteenth frame rate FR13 as the first luminance compensation data LCDAT11 corresponding to the first region R1 to the internal memory device 150 based on the frame rate information FRINFO. The internal memory device 150 may temporarily store the luminance compensation data LC13 and provide the luminance compensation data LC13 to the luminance compensation circuit 130. In the third frame F3, the external memory device 170 may provide the luminance compensation data LC17 corresponding to the seventeenth frame rate FR17 as the second luminance compensation data LCDAT12 to the internal memory device 150 based on the frame rate information FRINFO.

In some embodiments, the luminance compensation data LC13 may correspond to the frame rate dimming start frame FRDM_STR1 described above with reference to FIG. 11, and the luminance compensation data LC17 may correspond to the frame rate dimming end frame FRDM_END1 described above with reference to FIG. 11.

The internal memory device 150 may temporarily store the luminance compensation data LC13 and LC17 and provide the luminance compensation data LC13 and LC17 to the luminance compensation circuit 130.

In the fourth to ninth frames F4 to F9, the external memory device 170 and the internal memory device 150 do not provide the luminance compensation data corresponding to the first region R1 to the internal memory device 150 and the luminance compensation circuit 130, respectively. The luminance compensation data (e.g., LC14, LC15, LC16 and LC17) corresponding to the fourth to ninth frames F4 to F9 of the first region R1 may be generated by the luminance compensation circuit 130 based on the luminance compensation data (e.g., LC13 and LC17) provided in previous frames (e.g., F2 and F3).

In the tenth frame F10, the external memory device 170 may provide the luminance compensation data LC17 corresponding to the seventeenth frame rate FR17 as the second luminance compensation data LCDAT12 corresponding to the first region R1 to the internal memory device 150. The internal memory device 150 may temporarily store the luminance compensation data LC17 and provide the luminance compensation data LC17 to the luminance compensation circuit 130.

That is, when the frame rate dimming-on signal FRDO transitions to the second level and is maintained, the external memory device 170 may provide a portion of the plurality of luminance compensation data LC11 to LC20 to the internal memory device 150 once within a predetermined time interval. Further, when the frame rate dimming-on signal FRDO transitions to the first level and is maintained, the external memory device 170 may provide luminance compensation data corresponding to a frame rate with which the display panel operates from among the plurality of luminance compensation data LC11 to LC20 to the internal memory device 150 based on the frame rate information FRINFO whenever the frame number FN changes.

The second region R2 and the third region R3 will be described. The second region R2 and the third region R3 may also operate in a similar manner to the first region R1 described above. However, for the second region R2, the frame rate dimming-on signal FRDO2 may correspond to the first level from the first frame F1 up to the third frame F3, and correspond to the second level from the fourth frame F4 up to the tenth frame F10. For the third region R3, the frame rate dimming-on signal FRDO3 may correspond to the first level from the first frame F1 up to the fifth frame F5, the ninth frame F9 and the tenth frame F10, and correspond to the second level from the sixth frame F6 up to the eighth frame F8.

When the frame rate dimming-on signal FRDO2 transitions from the first level to the second level, it may represent an interval in which the frame rate of the second region R2 changes, and when the frame rate dimming-on signal FRDO2 transitions from the second level to the first level, it may represent an interval in which the frame rate of the second region R2 does not change. When the frame rate dimming-on signal FRDO3 transitions from the first level to the second level, it may represent an interval in which the frame rate of the third region R3 changes, and when the frame rate dimming-on signal FRDO1 transitions from the second level to the first level, it may represent an interval in which the frame rate of the third region R3 does not change.

Figure 14:
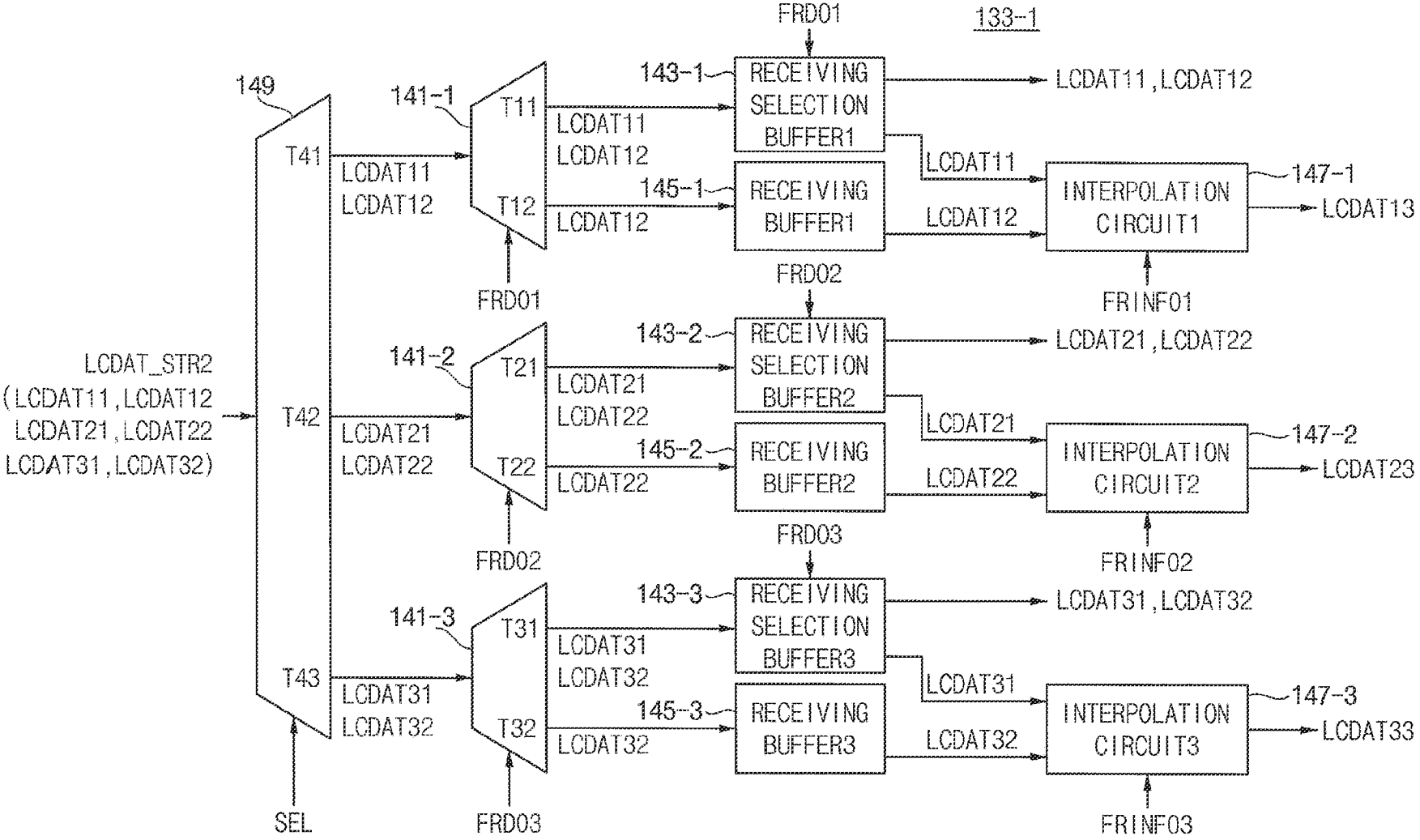
FIG. 14 is a block diagram illustrating an example of a luminance compensation data provider in FIG. 7.

FIG. 14 is a block diagram illustrating an example of a luminance compensation data provider in FIG. 7.

Referring to FIGS. 7 and 14, a luminance compensation data provider 133-1 may include first to fourth demultiplexers 149, 141-1, 141-2 and 141-3, first to third receiving selection buffers 143-1, 143-2 and 143-3, first to third receiving buffers 145-1, 145-2 and 145-3, and first to third interpolation circuits 147-1, 147-2 and 147-3.

The first demultiplexer 149 may receive first luminance compensation data LCDAT11, LCDAT21 and LCDAT31 and second luminance compensation data LCDAT12, LCDAT22 and LCDAT32 corresponding to first to third regions R1 to R3. In some embodiments, the first demultiplexer 149 may receive the first luminance compensation data LCDAT11, LCDAT21 and LCDAT31 and the second luminance compensation data LCDAT12, LCDAT22 and LCDAT32 from the internal memory device 150 in FIG. 1.

The first demultiplexer 149 may provide a portion of the first luminance compensation data LCDAT11, LCDAT21 and LCDAT31 and the second luminance compensation data LCDAT12, LCDAT22 and LCDAT32 to one of a third terminal T41, a fourth terminal T42 and a fifth terminal T43 in response to a selection signal SEL.

In some embodiments, when the selection signal SEL corresponds to the first region R1, the first demultiplexer 149 may provide first luminance compensation data LCDAT11 and second luminance compensation data LCDAT12 corresponding to the first region R1 to the second demultiplexer 141-1. When the selection signal SEL corresponds to the second region R2, the first demultiplexer 149 may provide first luminance compensation data LCDAT21 and second luminance compensation data LCDAT22 corresponding to the second region R2 to the third demultiplexer 141-2. When the selection signal SEL corresponds to the third region R3, the first demultiplexer 149 may provide first luminance compensation data LCDAT31 and the second luminance compensation data LCDAT32 corresponding to the third region R3 to the fourth demultiplexer 141-3.

The second demultiplexer 141-1 is connected to the third terminal T41 to receive the first luminance compensation data LCDAT11 and the second luminance compensation data LCDAT12 corresponding to the first region RE The second demultiplexer 141-1 may provide one of the first luminance compensation data LCDAT11 and the second luminance compensation data LCDAT12 to a sixth terminal T11 or provide the second luminance compensation data LCDAT12 to a seventh terminal T12, in response to frame rate dimming-on signal FRDO1. In some embodiments, the second demultiplexer 141-1 may provide one of the first luminance compensation data LCDAT11 and the second luminance compensation data LCDAT12 to the first receiving selection buffer 143-1 when the frame rate dimming-on signal FRDO1 corresponds to a first level, and provide the luminance compensation data LCDAT12 to the first receiving buffer 145-1 when the frame rate dimming-on signal FRDO1 corresponds to a second level.

The first receiving selection buffer 143-1 is connected to the sixth terminal T11 to receive and temporarily store the first luminance compensation data LCDAT11 and the second luminance compensation data LCDAT12 corresponding to the first region R1 from the second demultiplexer 141-1.

The first receiving selection buffer 143-1 may further receive the frame rate dimming-on signal FRDO1 and may output the first luminance compensation data LCDAT11 and the second luminance compensation data LCDAT12 to the image data compensator 131 or output the first luminance compensation data LCDAT11 to the first interpolation circuit 147-1, in response to the frame rate dimming-on signal FRDO1.

The first receiving buffer 145-1 is connected to the seventh terminal T12 to receive and temporarily store the second luminance compensation data LCDAT12 corresponding to the first region R1 from the second demultiplexer 141-1.

The first interpolation circuit 147-1 is connected to the first receiving selection buffer 143-1 and the first receiving buffer 147-1 to receive and temporarily store the first luminance compensation data LCDAT11 and the second luminance compensation data LCDAT12 corresponding to the first region R1.

The first interpolation circuit 147-1 further receives the frame rate information FRINFO1 and may generate third luminance compensation data LCDAT13 corresponding to the first region R1 in response to the frame rate information FRINFO1, the first luminance compensation data LCDAT11 and the second luminance compensation data LCDAT12. The first interpolation circuit 147-1 may output the third luminance compensation data LCDAT13 to the image data compensator 131.

The third demultiplexer 141-2, the second receiving selection buffer 143-2, the second receiving buffer 145-2 and the second interpolation circuit 147-2 may also operate for the second region R2 in a similar manner to the second demultiplexer 141-1, the first receiving selection buffer 143-1, the first receiving buffer 145-1 and the first interpolation circuit 147-1.

The fourth demultiplexer 141-3, the third receiving selection buffer 143-3, the third receiving buffer 145-3 and the third interpolation circuit 147-3 may also operate for the second region R3 in a similar manner to the second demultiplexer 141-1, the first receiving selection buffer 143-1, the first receiving buffer 145-1 and the first interpolation circuit 147-1.

Figure 15:
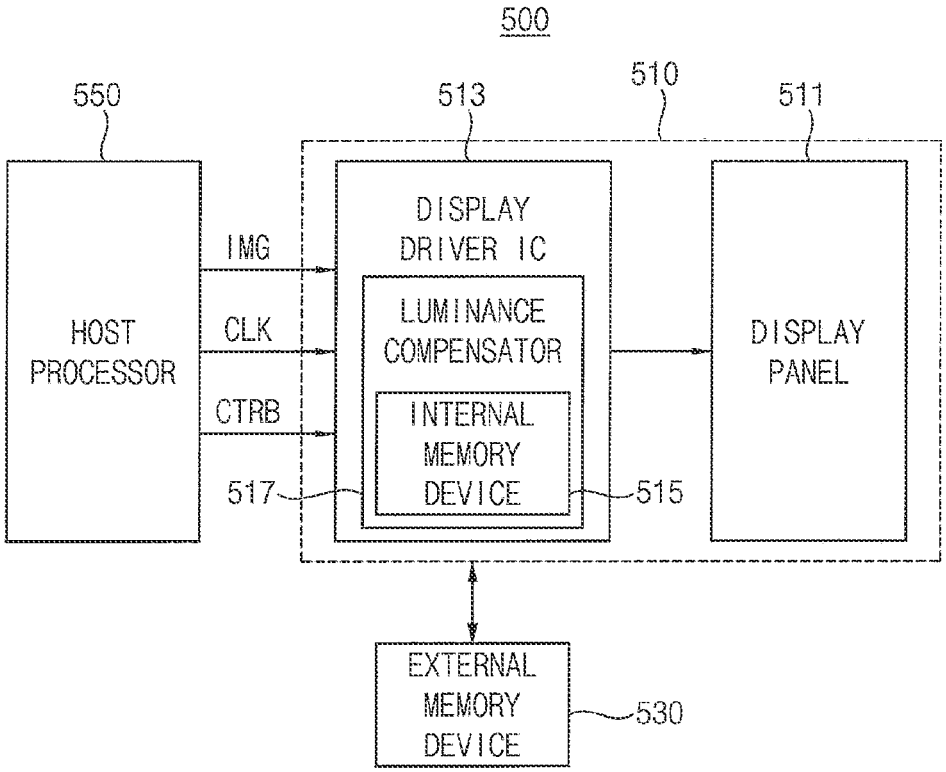
FIG. 15 is a block diagram illustrating a display system according to example embodiments.

FIG. 15 is a block diagram illustrating a display system according to example embodiments.

Referring to FIG. 15, a display system 500 may include a host processor 550, a display device 510 and an external memory device 530. The display device 510 may include a display panel 511 and a display driver integrated circuit (IC) 513.

The host processor 550 may overall control operations of the display system 500. In some embodiments, the host processor 550 may be implemented as an application processor (AP), a baseband processor (BBP) or a micro-processing unit (MPU).

The host processor 550 may provide a plurality of input image data IMG, a clock signal CLK and control signals CTRB required for operations of the display device 530. In some embodiments, the plurality of input image data IMG is related to input images, may include a plurality of RGB pixel values, and may be data having a resolution of W*H with a width of W and a height of H.

The control signals CTRB may include command signals, a horizontal synchronization signal, a vertical synchronization signal and a data enable signal. In some embodiments, the control signals CTRB may further include the selection signal SEL, the frame rate dimming-on signal FRDO and the frame rate information FRINFO described above with reference to FIG. 1. In some embodiments, the plurality of input image data IMG and the control signals CTRB may be provided to the display driver IC 513 in a form of a packet.

The command signals may include an image processing control signal, image information, and display environment setting information. In some embodiments, the image processing control signal may be a signal for controlling an internal memory device 515 and a luminance compensator 517 included in the display driver IC 513 to compensate pixel values of the plurality of input image data IMG. In some embodiments, the image information is information on the plurality of input image data IMG input to the display driver IC 513 and may include a resolution of each of the plurality of input image data IMG. The display environment setting information may include panel information and a luminance setting value.

The display driver IC 513 may drive the display panel 511 based on the plurality of input image data IMG and the control signals CTRB received from the host processor 550. The display driver IC 513 may convert the plurality of input image data IMG, which are digital signals, into analog signals and drive the display panel 511 with the analog signals.

The display driver IC 513 may include a luminance compensator 517. The luminance compensator 517 may be the luminance compensator 110 in FIG. 1. Accordingly, the luminance compensator 517 may include the luminance compensation circuit 130 in FIGS. 1 and 7 and may include the luminance compensation data provider 133 and the image data compensator 131 described above with reference to FIG. 7.

The display panel 511 is a panel that displays the plurality of input image data IMG, may operate with a plurality of frame rates as described above with reference to FIG. 1, and may further include at least one region capable of operating with different frame rates. In some embodiments, the display panel 511 may include a liquid crystal display (LCD) panel, an electrophoretic display panel, an organic light emitting diode (OLED) panel, a light emitting diode (LED) panel, an electro luminescent display panel, a field emission display (FED) panel, a surface-conduction electron-emitter display (SED) panel, a plasma display panel (PDP), a cathode ray tube (CRT), or the like.

The display system 500 may be implemented as a mobile phone having an image display function, a smartphone, a tablet personal computer (PC), a personal digital assistant (PDA), a wearable electronic device or a potable multimedia player (PMP). The display system 500 may be implemented with various electronic devices such as a TV, a notebook computer, a desktop PC and a navigation device.

Figure 16:
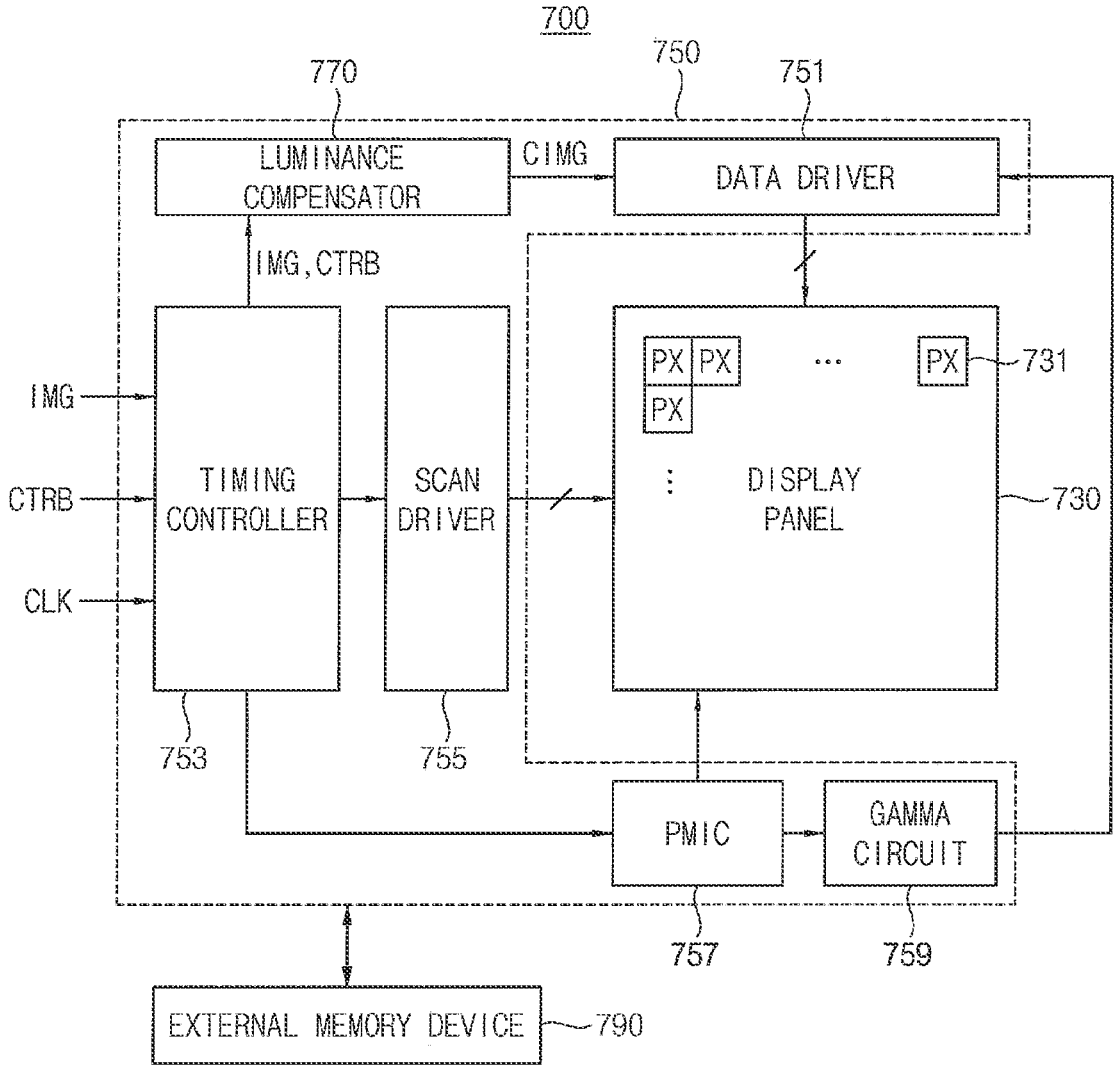
FIG. 16 is a block diagram illustrating a display system according to example embodiments.

FIG. 16 is a block diagram illustrating a display system according to example embodiments.

Referring to FIG. 16, a display device 700 includes a display panel 730 including a plurality of pixels rows 731, a display driver 750 driving the display panel 730 and an external memory device 790.

The display driver 750 includes a data driver 751, a scan driver 755, a timing controller 753, a power supply unit 757, a gamma circuit 759 and a luminance compensator 770.

The display panel 730 may be connected to the data driver 751 of the display driver 750 through data lines, and may be connected to the scan driver 755 of the display driver 750 through scan lines. The display panel 730 may include pixel rows 731. The display panel 730 may include pixels PX arranged in a matrix of rows and columns. One pixel row 731 refers to one row of pixels PX that may be connected to the same scan line.

In some embodiments, each pixel PX included in the display panel 230 may have various configurations according to a driving method. For example, the driving method may be classified into analog driving or digital driving according to a method of expressing gray levels. The luminance compensation method according to example embodiments may be applied to both analog and digital driving.

The data driver 751 may apply a data signal to the display panel 730 through the data lines, and the scan driver 755 may apply a scan signal to the display panel 730 through the scan lines. The timing controller 753 may control operations of the display device 710. The timing controller 753 may control operation of the display device 710 by providing predetermined control signals to the data driver 751 and the scan driver 755.

In some embodiments, the data driver 751, the scan driver 755 and the timing controller 753 may be implemented as a single integrated circuit (IC). In some embodiments, the data driver 751, the scan driver 755 and the timing controller 753 may be implemented with two or more ICs. At least a driving module in which the timing controller 753 and the data driver 751 are integrally formed may be referred to as a timing controller embedded data driver (TED).

The timing controller 753 receives a plurality of input image data IMG and control signals CTRB from a host device, e.g., the host processor 550 illustrated in FIG. 15. For example, the input image data IMG may include red image data R, green image data G and blue image data B. The input image data IMG may include white image data. The input image data IMG may include magenta image data, yellow image data and cyan image data.

The control signals CTRB may include command signals, a vertical synchronization signal, a horizontal synchronization signal and a data enable signal. In some embodiments, the control signals CTRB may further include the selection signal SEL, the frame rate dimming-on signal FRDO and the frame rate information FRINFO described above with reference to FIG. 1.

The power supply 757 may supply a power voltage and a ground voltage to the display panel 730. In some embodiments, the power voltage may correspond to a high power voltage and the ground voltage may correspond to a low power voltage. Also, the power supply 757 may supply a regulator voltage to the gamma circuit 759. The gamma circuit 759 may generate a plurality of gamma reference voltages based on the regulator voltage. For example, the regulator voltage may be a power voltage or a voltage generated by a separate regulator voltage based on the power voltage.

The external memory device 790 may correspond to the external memory device 170 described above with reference to FIG. 1.

The luminance compensator 770 may generate luminance compensation data for compensating the luminance of the display panel 730 according to example embodiments. In FIG. 16, the luminance compensator 770 is illustrated to be disposed between the data driver 751 and the timing controller, but example embodiments are not limited thereto. In some embodiments, the luminance compensator 770 may be included in the timing controller 753 or may be disposed in front of the timing controller 753.

Figure 17:
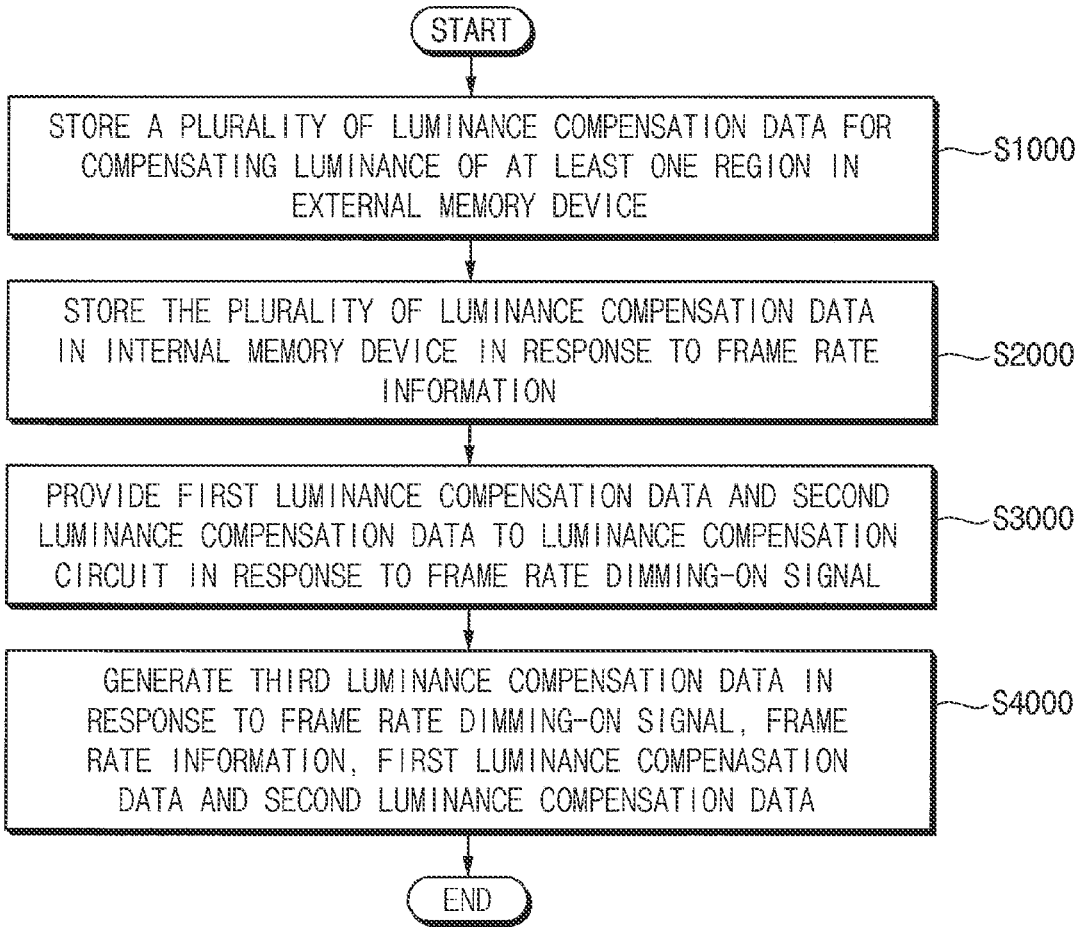
FIG. 17 is a flowchart illustrating a method of compensating luminance according to example embodiments.

FIG. 17 is a flowchart illustrating a method of compensating luminance according to example embodiments.

Referring to FIG. 17, a plurality of luminance compensation data for compensating luminance of at least one region are stored in an external memory device (S1000). The plurality of luminance compensation data are stored in an internal memory device in response to frame rate information (S2000). First luminance compensation data and second luminance compensation data are provided to a luminance compensation circuit in response to a frame rate dimming-on signal (S3000). Third luminance compensation data is generated in response to the frame rate dimming-on signal, the first luminance compensation data and the second luminance compensation data (S4000).

Figure 18:
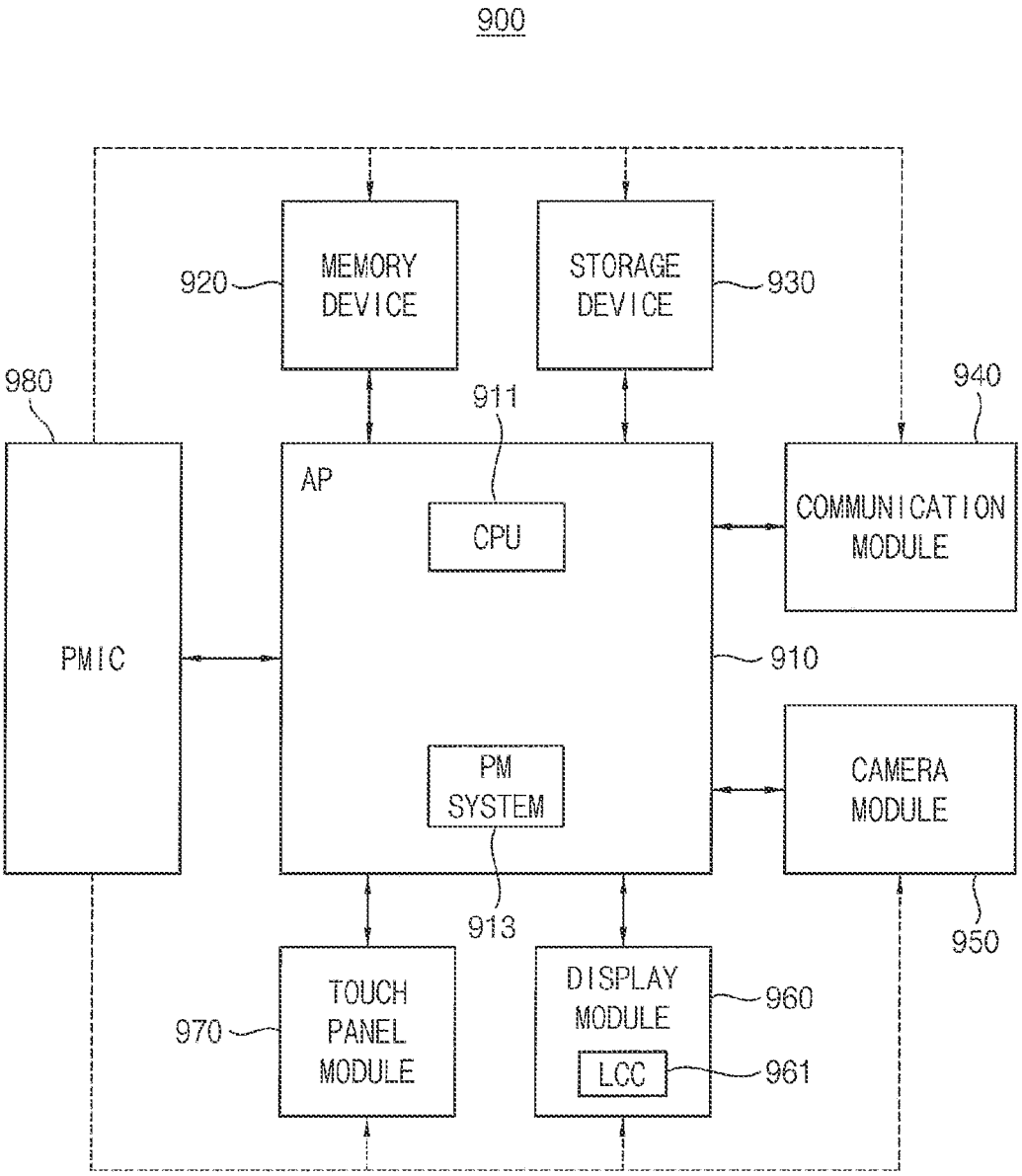
FIG. 18 is a block diagram illustrating a display mobile device according to example embodiments.

FIG. 18 is a block diagram illustrating a display mobile device according to example embodiments.

Referring to FIG. 18, the display mobile device 900 may include a system-on-chip 910 and functional modules 940, 950, 960 and 970. The display mobile device 900 may further include a memory device 920, a storage device 930 and a power management device 980.

The system-on-chip 910 may control the overall operation of the display mobile device 900 and its constituent components (e.g.,) the memory device 920, the storage device 930 and the functional modules 940, 950, 960 and 970. In some embodiments, the system-on-chip 910 may be an application processor (AP) provided in the display mobile device 900.

The system-on-chip 910 may include a central processing unit 911 and a power management system 913. The memory device 920 and the storage device 930 may store data necessary for operations of the display mobile device 900. For example, the memory device 920 may correspond to a volatile memory device such as a dynamic random access memory (DRAM) device, a static random access memory (SRAM) device, a mobile DRAM device, and the like, and the storage device 930 may correspond to a nonvolatile memory device such as an EPROM (erasable programmable read-only memory) device, an electrically erasable programmable read-only memory (EEPROM) device, a flash memory device, a phase change random access memory (PRAM) device, a resistance random access memory (RRAM) device, NFGM device, a polymer random access memory (PoRAM) device, a magnetic random access memory (MRAM) device, or a ferroelectric random access memory (FRAM) device. In some embodiments, the storage device 930 may further include a solid state drive (SSD), a hard disk drive (HDD), a CD-ROM, or the like.

The functional modules 940, 950, 960 and 970 may respectively perform various functions of the display mobile device 900. For example, the display mobile device 900 may include: (1) a communication module 940 for performing a communication function, e.g., a code division multiple access (CDMA) module, a long term evolution (LTE) module, a radio frequency (RF) module, an ultra-wideband (UWB) module, a wireless local area network (WLAN) module, a worldwide interoperability for microwave access (WIMAX) module, etc., (2) a camera module 950 for performing a camera function, (3) a display module 960 for performing a display function, and (4) a touch panel module 970 for performing a touch input function, and the like. In some embodiments, the display mobile device 900 may further include a global positioning system (GPS) module, a microphone module, a speaker module, a gyroscope module, and the like. However, those skilled in the art will recognize that many different functional modules 940, 950, 960 and 970 may be included in the display mobile device 900.

The power management device 980 may provide driving voltages to the system-on-chip 910, the memory device 920, the storage device 930 and the functional modules 940, 950, 960 and 970, respectively.

According to example embodiments, the display module 960 may include the luminance compensation circuit 961. The luminance compensation circuit 961 may correspond to the luminance compensation circuit 130 described above with reference to FIG. 1.

As described above, the luminance compensator according to example embodiments may be used to compensate luminance of a display panel operating with a plurality of frame rates including at least one region. An external memory device may store a plurality of luminance compensation data, and an internal memory device may store only a portion of the plurality of luminance compensation data. The luminance compensator may generate luminance compensation data for compensating the luminance of the display panel using only a portion of the luminance compensation data stored in the internal memory device. Accordingly, even when at least one region included in the display panel operates with at least one frame rate, luminance compensation data may be efficiently generated and it is possible to reduce consumption of memory resources and perform luminance compensation optimized for the region.

As is traditional in the field, embodiments may be described and illustrated in terms of blocks which carry out a described function or functions. These blocks, which may be referred to herein as units or modules or the like, are physically implemented by analog and/or digital circuits such as logic gates, integrated circuits, microprocessors, microcontrollers, memory circuits, passive electronic components, active electronic components, optical components, hardwired circuits and the like, and may optionally be driven by firmware and/or software. The circuits may, for example, be embodied in one or more semiconductor chips, or on substrate supports such as printed circuit boards and the like. The circuits constituting a block may be implemented by dedicated hardware, or by a processor (e.g., one or more programmed microprocessors and associated circuitry), or by a combination of dedicated hardware to perform some functions of the block and a processor to perform other functions of the block. Each block of the embodiments may be physically separated into two or more interacting and discrete blocks without departing from the scope of the disclosure. Likewise, the blocks of the embodiments may be physically combined into more complex blocks without departing from the scope of the disclosure. An aspect of an embodiment may be achieved through instructions stored within a non-transitory storage medium and executed by a processor.

The foregoing is illustrative of example embodiments and is not to be construed as limiting thereof. Although some example embodiments have been described, those skilled in the art will readily appreciate that many modifications are possible in the example embodiments without materially departing from the novel teachings and advantages of the example embodiments. Accordingly, all such modifications are intended to be included within the scope of the example embodiments as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A luminance compensator comprising:

a memory device configured to store a plurality of luminance compensation data and provide first luminance compensation data and second luminance compensation data among the plurality of luminance compensation data in response to a frame rate dimming-on signal, the first luminance compensation data corresponding to a first frame rate, the second luminance compensation data corresponding to a second frame rate, the plurality of luminance compensation data for compensating luminance of at least one region that is included in a display panel and operates with a plurality of frame rates, the frame rate dimming-on signal representing time intervals in which the frame rates of the at least one region are gradually changed; and a luminance compensation circuit configured to:

receive the first luminance compensation data in response to the frame rate dimming-on signal reflecting a first level, receive the first frame rate and the second frame rate in response to the frame rate dimming-on signal transitioning from the first level to a second level differing from the first level, acquire the second luminance compensation data from the memory device in response to receiving the second frame rate, and generate third luminance compensation data corresponding to a third frame rate, received subsequent to receiving the first frame rate and the second frame rate, in response to acquiring the second luminance compensation data, wherein the third luminance compensation data is based on the first luminance compensation data, the second luminance compensation data, and the third frame rate, wherein the luminance compensation circuit is further configured to:

receive frame rate information representing a frame rate of the at least one region, and perform interpolation on the first luminance compensation data and the second luminance compensation data in response to the frame rate information to generate the third luminance compensation data, wherein the luminance compensation circuit includes:

a luminance compensation data provider configured to:

receive the frame rate dimming-on signal, the frame rate information, the first luminance compensation data, and the second luminance compensation data, and generate the third luminance compensation data in response to the frame rate information, the first luminance compensation data, the second luminance compensation data, and the frame rate dimming-on signal; and an image data compensator configured to:

receive a plurality of input image data and the third luminance compensation data, and compensate the plurality of input image data in response to the third luminance compensation data to generate a plurality of output image data for displaying an image, wherein when the frame rate dimming-on signal corresponds to a first level, the luminance compensation data provider is configured to output one of the first luminance compensation data and the second luminance compensation data, and when the frame rate dimming-on signal corresponds to a second level different from the first level, the luminance compensation data provider is configured to output the third luminance compensation data, wherein the luminance compensation data provider includes:

a demultiplexer configured to provide the first luminance compensation data and the second luminance compensation data to a first terminal or provide the second luminance compensation data to a second terminal in response to the frame rate dimming-on signal;

a receiving selection buffer connected to the first terminal and configured to receive the first luminance compensation data and the second luminance compensation data and store the first luminance compensation data and the second luminance compensation data;

a receiving buffer connected to the second terminal and configured to receive the second luminance compensation data and store the second luminance compensation data; and an interpolation circuit connected to the receiving selection buffer and the receiving buffer and configured to:

receive the first luminance compensation data and the second luminance compensation data, and generate the third luminance compensation data in response to the frame rate information, the first luminance compensation data, and the second luminance compensation data.

2. The luminance compensator of claim 1, wherein:

the plurality of luminance compensation data is stored in an external memory device, and the memory device is configured to receive the plurality of luminance compensation data from the external memory device and provide the first luminance compensation data and the second luminance compensation data to the luminance compensation circuit.

3. The luminance compensator of claim 1, wherein:

when the frame rate dimming-on signal corresponds to the first level, the demultiplexer is configured to provide one of the first luminance compensation data and the second luminance compensation data to the receiving selection buffer, and when the frame rate dimming-on signal corresponds to the second level, the demultiplexer is configured to provide the second luminance compensation data to the receiving buffer.

4. The luminance compensator of claim 1, wherein the receiving selection buffer is configured to provide one of the first luminance compensation data and the second luminance compensation data to the image data compensator in response to the frame rate dimming-on signal.

5. The luminance compensator of claim 1, wherein the receiving selection buffer is configured to provide the first luminance compensation data to the interpolation circuit in response to the frame rate dimming-on signal.

6. The luminance compensator of claim 5, wherein when the frame rate dimming-on signal corresponds to the second level, the interpolation circuit is configured to interpolate the first luminance compensation data and the second luminance compensation data in response to the frame rate information to generate the third luminance compensation data.

7. The luminance compensator of claim 1, wherein the first to the third luminance compensation data are generated for each of K regions.

8. The luminance compensator of claim 1, wherein:

the at least one region includes first to X-th regions operating with different frame rates with respect to each other, where X is a natural number greater than or equal to two, and the frame rate dimming-on signal is set independently for each of the first to X-th regions.

9. The luminance compensator of claim 8, wherein:

a frame rate of the first region is gradually changed from the first frame rate to the second frame rate, and a frame rate of the second region is gradually changed from the third frame rate different from the first frame rate to a fourth frame rate different from the second frame rate.

10. The luminance compensator of claim 1, wherein:

the first frame rate is higher than the second frame rate, and the third frame rate is lower than the first frame rate and higher than the second frame rate.

11. The luminance compensator of claim 1, wherein the memory device is configured to receive the plurality of luminance compensation data from an external memory device within a predetermined time interval before the frame rate dimming-on signal transitions from a first level to a second level.

12. The luminance compensator of claim 1, wherein the memory device is configured to receive the plurality of luminance compensation data from an external memory device within a predetermined time interval after the frame rate dimming-on signal transitions from a first level to a second level.

13. A luminance compensator comprising:

a memory device configured to store a plurality of luminance compensation data and provide first luminance compensation data and second luminance compensation data among the plurality of luminance compensation data in response to a frame rate dimming-on signal, the first luminance compensation data corresponding to a first frame rate, the second luminance compensation data corresponding to a second frame rate, the plurality of luminance compensation data for compensating luminance of at least one region that is included in a display panel and operates with a plurality of frame rates, the frame rate dimming-on signal representing time intervals in which frame rates of the at least one region are gradually changed; and a luminance compensation circuit configured to generate third luminance compensation data corresponding to a third frame rate in response to the frame rate dimming-on signal, the first luminance compensation data, and the second luminance compensation data, wherein the luminance compensation circuit is configured to receive frame rate information representing a frame rate of the at least one region, and perform interpolation on the first luminance compensation data and the second luminance compensation data in response to the frame rate information to generate the third luminance compensation data, wherein the luminance compensation circuit includes:

a luminance compensation data provider configured to:

receive the frame rate dimming-on signal, the frame rate information, the first luminance compensation data, and the second luminance compensation data, and generate the third luminance compensation data in response to the frame rate information, the first luminance compensation data, the second luminance compensation data, and the frame rate dimming-on signal; and an image data compensator configured to:

receive a plurality of input image data and the third luminance compensation data, and compensate the plurality of input image data in response to the third luminance compensation data to generate a plurality of output image data for displaying an image, wherein when the frame rate dimming-on signal corresponds to a first level, the luminance compensation data provider is configured to output one of the first luminance compensation data and the second luminance compensation data, and when the frame rate dimming-on signal corresponds to a second level different from the first level, the luminance compensation data provider is configured to output the third luminance compensation data, and wherein the luminance compensation data provider includes:

a demultiplexer configured to provide the first luminance compensation data and the second luminance compensation data to a first terminal or provide the second luminance compensation data to a second terminal in response to the frame rate dimming-on signal;

a receiving selection buffer connected to the first terminal and configured to receive the first luminance compensation data and the second luminance compensation data and store the first luminance compensation data and the second luminance compensation data;

a receiving buffer connected to the second terminal and configured to receive the second luminance compensation data and store the second luminance compensation data; and an interpolation circuit connected to the receiving selection buffer and the receiving buffer and configured to:

receive the first luminance compensation data and the second luminance compensation data, and generate the third luminance compensation data in response to the frame rate information, the first luminance compensation data, and the second luminance compensation data.

* * * * *